US009563165B2

(12) United States Patent
Nakamura

(10) Patent No.: US 9,563,165 B2
(45) Date of Patent: Feb. 7, 2017

(54) IMAGE FORMING APPARATUS

(71) Applicant: Konica Minolta, Inc., Chiyoda-ku, Tokyo (JP)

(72) Inventor: Yasuo Nakamura, Toyokawa (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/664,054

(22) Filed: Mar. 20, 2015

(65) Prior Publication Data

US 2015/0268611 A1 Sep. 24, 2015

(30) Foreign Application Priority Data

Mar. 20, 2014 (JP) ..... 2014-058590

(51) Int. Cl.

| | |
|---|---|
| ***G03G 15/00*** | (2006.01) |
| ***B65H 1/14*** | (2006.01) |
| ***B65H 7/08*** | (2006.01) |
| ***B65H 3/06*** | (2006.01) |

(52) U.S. Cl.

CPC ..... *G03G 15/657* (2013.01); *B65H 1/14* (2013.01); *B65H 3/0607* (2013.01); *B65H 3/0669* (2013.01); *B65H 7/08* (2013.01); *G03G 15/6564* (2013.01); *B65H 2403/47* (2013.01); *B65H 2403/721* (2013.01); *B65H 2511/152* (2013.01); *B65H 2511/30* (2013.01); *B65H 2513/50* (2013.01); *B65H 2513/514* (2013.01)

(58) Field of Classification Search

CPC ..... B65H 7/14
USPC ..... 399/397
See application file for complete search history.

(56) References Cited

U.S. PATENT DOCUMENTS

| | | | | |
|---|---|---|---|---|
| 6,181,907 | B1 * | 1/2001 | Hong | G03G 15/6564 399/388 |
| 6,341,774 | B1 * | 1/2002 | Ueda | B65H 3/0638 271/119 |
| 6,540,221 | B2 * | 4/2003 | Nakashima | B65H 3/5223 271/121 |
| 6,554,272 | B2 * | 4/2003 | Otake | B65H 3/5223 271/121 |

(Continued)

FOREIGN PATENT DOCUMENTS

| | | |
|---|---|---|
| JP | 2003002457 A | 1/2003 |
| JP | 2003206039 A | 7/2003 |
| JP | 2011051767 A | 3/2011 |

*Primary Examiner* — Anthony Nguyen
(74) *Attorney, Agent, or Firm* — Cantor Colburn LLP

(57) ABSTRACT

An image forming apparatus feeds a recording sheet from a sheet feed roller, clamps the recording sheet between an image carrier and a transfer roller, transfers a toner image to the recording sheet from the image carrier while conveying the recording sheet, and fixes the transferred toner image on the recording sheet. Recording sheets are stacked on an elevating plate. An elevating plate swinging mechanism vertically swings the elevating plate. A rotation drive mechanism rotates the sheet feed roller in synchronism with the elevating plate swinging mechanism. A recording sheet detector detects a leading edge of each recording sheet fed from the sheet feed roller. A conveyance controller measures sheet feed time from starting a sheet feed operation to detecting the leading edge of the recording sheet. Based on the measured sheet feed time, the conveyance controller sets a sheet feed start timing of a next recording sheet.

21 Claims, 23 Drawing Sheets

(56) References Cited

U.S. PATENT DOCUMENTS

| | | | | |
|---|---|---|---|---|
| 8,167,300 | B1 * | 5/2012 | Blair | B65H 1/14 271/155 |
| 2006/0157915 | A1 * | 7/2006 | Ogawa | B65H 1/08 271/126 |
| 2006/0208414 | A1 * | 9/2006 | Amarakoon | B65H 7/08 271/10.02 |
| 2006/0261535 | A1 * | 11/2006 | Shiohara | B41J 11/485 271/9.01 |
| 2009/0202282 | A1 * | 8/2009 | Baek | G03G 15/6573 399/397 |
| 2010/0059929 | A1 * | 3/2010 | Okumura | B65H 3/0607 271/117 |
| 2012/0112407 | A1 * | 5/2012 | Hirajima | B65H 3/0607 271/265.01 |
| 2012/0146281 | A1 * | 6/2012 | Nishii | B65H 7/18 271/110 |

* cited by examiner

IMAGE FORMING APPARATUS

CROSS-REFERENCE TO RELATED APPLICATIONS

The present application claims priority under 35 U.S.C. §119 to Japanese Patent Application No. 2014-058590, filed Mar. 20, 2014. The contents of this application are incorporated herein by reference in their entirety.

BACKGROUND OF THE INVENTION

Field of the Invention

The present invention relates to an image forming apparatus.

Discussion of the Background

A conventional image forming apparatus includes a sheet feeder on which a plurality of recording sheets are stacked. The recording sheets stacked on the sheet feeder are drawn out to a conveyance path inside of the apparatus by a sheet feed roller and conveyed to a transfer roller by a plurality of conveyance roller pairs (see Japanese Patent No. 3885869). As typically exemplified by the image forming apparatus disclosed in Japanese Patent No. 3885869, the sheet feeder of the conventional image forming apparatus includes a swingable elevating plate (stacking support). The elevating plate on which recording sheets are stacked is swung vertically by drive means to bring the uppermost recording sheet into contact with the sheet feed roller.

The contents of Japanese Patent No. 3885869 are incorporated herein by reference in their entirety.

In the conventional image forming apparatus, the elevating plate is moved vertically by rotation of gears, and consequently, the speed of the vertical movement is low. Therefore, when the rotation of the sheet feed roller and the vertical movement of the elevating plate are executed by the same drive source, a sheet feed timing by the sheet feed roller varies depending on an amount of recording sheets stacked on the elevating plate (height of recording sheets mounted on the elevating plate). Moreover, in recent years, there has been a demand for reducing an image forming apparatus in size, and there has been proposed an image forming apparatus without conveyance roller pairs between a sheet feed roller and a transfer roller. In the case of such an image forming apparatus having no conveyance roller pairs between the sheet feed roller and the transfer roller, the sheet feed timing may vary depending on an amount of recording sheets stacked on the elevating plate. Then, positions of transfer of toner images to recording sheets differ to hinder acquisition of stable images.

In view of the above-described problems, it is an object of the present invention to provide an image forming apparatus to directly convey a recording sheet from a sheet feed roller to a transfer roller in order to stabilize the conveyance of the recording sheet without increasing the number of component parts.

SUMMARY OF THE INVENTION

According to one aspect of the present invention, an image forming apparatus is configured to feed a recording sheet from a sheet feed roller, clamp the recording sheet between an image carrier and a transfer roller, transfer a toner image to the recording sheet from the image carrier while conveying the recording sheet, and fix the transferred toner image on the recording sheet at a fixing unit. The image forming apparatus includes an elevating plate, an elevating plate swinging mechanism, a rotation drive mechanism, a recording sheet detector, and a conveyance controller. Recording sheets are stacked on the elevating plate. The elevating plate swinging mechanism is configured to swing the elevating plate to move vertically. The rotation drive mechanism is configured to rotate the sheet feed roller in synchronism with the elevating plate swinging mechanism. The recording sheet detector is configured to detect a leading edge of each recording sheet fed from the sheet feed roller. The conveyance controller is configured to drive the elevating plate swinging mechanism to swing the elevating plate and configured to rotate the sheet feed roller to feed a recording sheet. When executing a sheet feed operation of the recording sheet, the conveyance controller is configured to measure sheet feed time from starting the sheet feed operation to detecting the leading edge of the recording sheet by the recording sheet detector. Based on the measured sheet feed time, the conveyance controller is configured to set a sheet feed start timing for starting a sheet feed operation of a next recording sheet.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
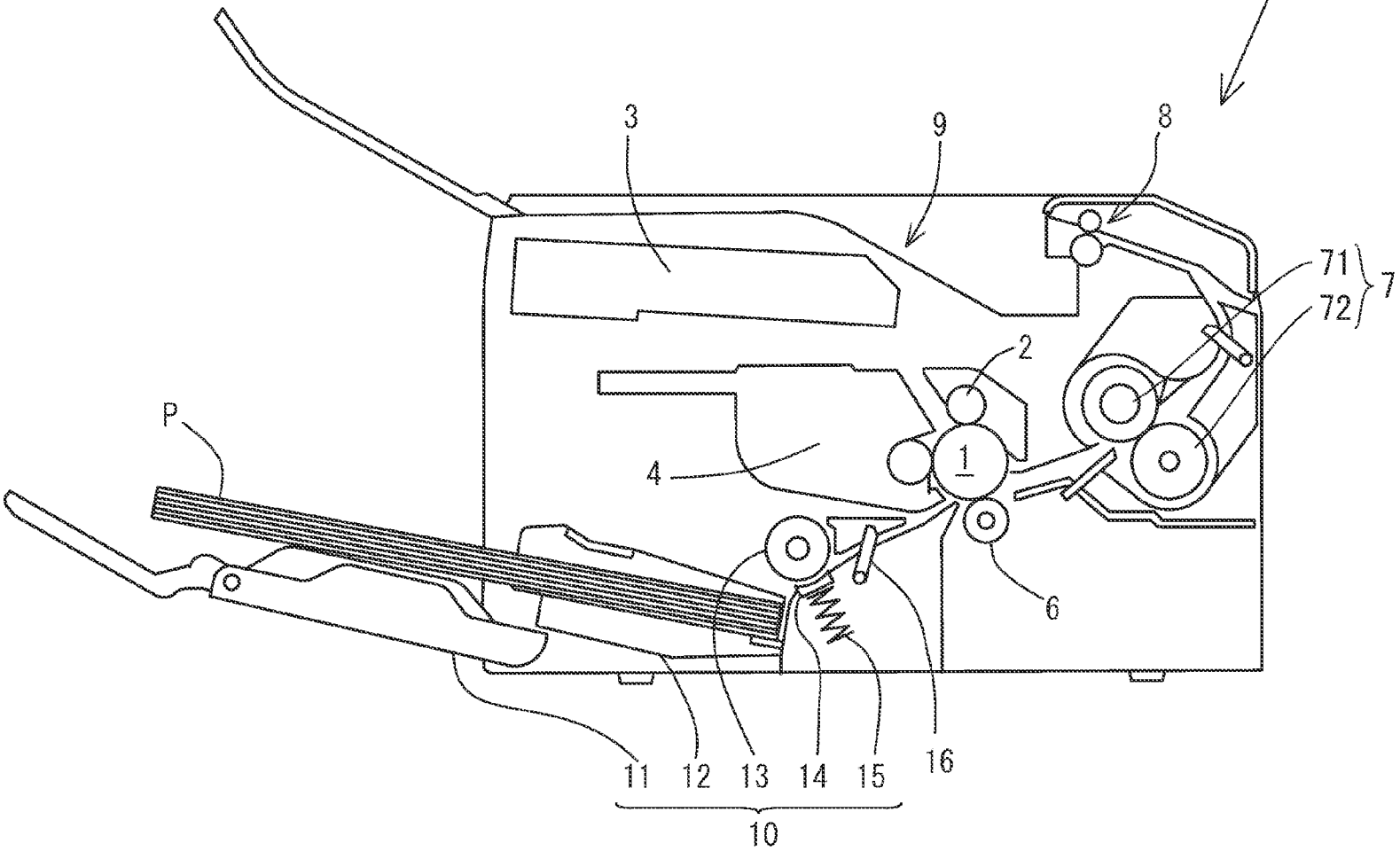
FIG. 1 is a schematic diagram illustrating a configuration of an image forming apparatus according to an embodiment of the present invention.

A configuration of an image forming apparatus according to an embodiment of the present invention will be described below with reference to the accompanying drawings. Here, a printer will be taken as an example. FIG. 1 is a schematic diagram illustrating the configuration of the image forming apparatus according to the embodiment.

The image forming apparatus D shown in FIG. 1 includes an electrification roller 2, an exposure unit 3, a developer 4, a transfer roller 6, and a fixing unit 7, all of which are disposed around a cylindrical photoconductor (image carrier) 1. The photoconductor 1 carries a toner image and rotates counterclockwise. The electrification roller 2 uniformly electrifies the surface of the photoconductor 1. The exposure unit 3 irradiates the surface of the photoconductor 1 with light to form an electrostatic latent image. The developer 4 supplies toner to the photoconductor 1 and develops the electrostatic latent image on the photoconductor 1 to form a toner image. The transfer roller 6 transfers the toner image on the photoconductor 1, which has been formed by the developer 4, to a recording sheet P. The fixing unit 7 fixes the toner image on the recording sheet P.

Also, the image forming apparatus D includes a sheet feeder 10 in a lower portion of the apparatus. The sheet feeder 10 includes a recording sheet tray 11, an elevating plate 12, a sheet feed roller 13, a recording sheet separator 14, and a helical compression spring 15. Recording sheets P are stacked on the recording sheet tray 11. The elevating plate 12 vertically moves leading edge portions of the recording sheets P in a conveyance direction. The recording sheet separator 14 moves to a position in contact with the sheet feed roller 13 and a position separate from the sheet feed roller 13. The helical compression spring 15 urges the recording sheet separator 14 toward the sheet feed roller 13. The elevating plate 12 swings upwardly, and also, the recording sheet separator 14 moves to the position in contact with the sheet feed roller 13. Then, the sheet feed roller 13 draws out the recording sheets P one by one from the uppermost sheet to a conveyance path.

The image forming apparatus D includes a timing sensor 16 to detect recording sheets P. The timing sensor 16 is disposed on the conveyance path between the sheet feed roller 13 and the transfer roller 6. The timing sensor (recording sheet detector) 16 is a photoelectric sensor and detects a leading edge of each recording sheet P conveyed from the sheet feed roller 13. Specifically, when each recording sheet P is fed from the sheet feeder 10 to the conveyance path by the sheet feed roller 13, the timing sensor 16 detects a leading edge of the recording sheet P on the conveyance path. Detection of the leading edge of the recording sheet P by the timing sensor 16 becomes a trigger to cause the exposure unit 3 to form an electrostatic latent image on the surface of the photoconductor 1.

An image forming operation will now be described. First, an outer peripheral surface of the photoconductor 1 rotating at a predetermined circumferential speed is uniformly electrified by the electrification roller 2. Next, based on image data input from an external device such as a personal computer, the exposure unit 3 irradiates the electrified surface of the photoconductor 1 with light to form an electrostatic latent image on the photoconductor 1. Subsequently, the electrostatic latent image is rendered manifest by toner supplied from the developer 4. The toner image, which has been formed on the surface of the photoconductor 1 in this manner, is conveyed to a nip portion (transfer area) between the photoconductor 1 and the transfer roller 6 by rotation of the photoconductor 1. The transfer roller 6 is rotated by a drive motor 39 (see FIG. 23) and is in contact with the photoconductor 1 under pressure by a helical compression spring (not shown). Also, a transfer bias voltage is applied to the transfer roller 6 by voltage application means (not shown).

Recording sheets P stacked on the recording sheet tray 11 are drawn to the conveyance path one by one from the uppermost sheet by the sheet feed roller 13. The timing sensor 16 detects a position of a leading edge of each recording sheet P. In accordance with a rotation timing of the photoconductor 1, the recording sheet P is conveyed to the transfer area. When the recording sheet P passes the nip portion between the photoconductor 1 and the transfer roller 6, a transfer bias voltage is applied to the transfer roller 6 to transfer the toner image formed on the photoconductor 1 to the recording sheet P. The recording sheet P to which the toner image has been transferred is conveyed to the fixing unit 7.

The fixing unit 7 includes a heating roller (fixing roller) 71 and a pressurizing roller 72. The heating roller 71 heats a printing surface of the recording sheet P. The pressurizing roller 72 is opposed to the heating roller 71 to clamp and pressurize the recording sheet P. In the fixing unit 7, the recording sheet P is heated and pressurized by the heating roller 71 and the pressurizing roller 72 to fuse and fix the toner image on the recording sheet P. The recording sheet P on which the toner image has been fixed is discharged to a sheet discharge tray 9 by a sheet discharge roller pair 8.

In the image forming apparatus D, no conveyance roller pair are disposed on the conveyance path between the sheet feed roller 13 to a nip portion between the heating roller 71 and the pressurizing roller 72 in the fixing unit 7. Thus, the conveyance path is shortened to make the apparatus compact. Moreover, in the image forming apparatus D, a circumferential speed of the transfer roller 6 is higher than a circumferential speed of the sheet feed roller 13. This prevents the recording sheet P from slackening in a loop shape in the conveyance path and suppresses the volume of the conveyance path to the minimum level. Consequently, the apparatus is further reduced in size.

When the image forming apparatus D starts feeding recording sheets P, the elevating plate 12 is moved upwardly to bring the recording sheets P stacked on the elevating plate 12 into contact with the sheet feed roller 13 and to move the recording sheet separator 14 from the separate position to the contact position at the same time. In accordance with swinging of the elevating plate 12 to move upwardly, a drive shaft 17 (see FIG. 2) of the sheet feed roller 13 is rotated whereas the sheet feed roller 13 is stopped. When a predetermined period of time elapses after the start of swinging of the elevating plate 12, the sheet feed roller 13 starts rotating to draw the uppermost one of the recording sheets P stacked on the elevating plate 12 to the conveyance path. Thus, the sheet feed roller 13 and the recording sheet separator 14 clamp and convey the recording sheet P to the transfer roller 6.

This leads to a state in which the recording sheet P is clamped both between the sheet feed roller 13 and the recording sheet separator 14 and between the photoconductor 1 and the transfer roller 6. At this time, by conveyance force of the photoconductor 1 and the transfer roller 6 having high circumferential speeds, the recording sheet P is drawn out from between the sheet feed roller 13 and the recording sheet separator 14. Then, the photoconductor 1 and the transfer roller 6 clamp the recording sheet P to transfer the toner image on the photoconductor 1 to the recording sheet P and at the same time convey the recording sheet P to the fixing unit 7.

When the leading edge of the recording sheet P reaches the fixing unit 7, the leading edge of the recording sheet P is clamped in the nip portion between the heating roller 71 and the pressurizing roller 72. This leads to a state in which the recording sheet P is clamped all between the sheet feed roller 13 and the recording sheet separator 14, between the photoconductor 1 and the transfer roller 6, and between the heating roller 71 and the pressurizing roller 72. At this time, the recording sheet separator 14 is moved from the contact position to the separate position, and also, the sheet feed roller 13 is idled. This suppresses increases in drive loads of the photoconductor 1, the transfer roller 6, the heating roller 71, and the pressurizing roller 72 so as to convey the recording sheet P stably. Therefore, a change in the conveyance speed of the recording sheet P is prevented from causing irregularity in the toner image transferred to the recording sheet P.

Figure 2:
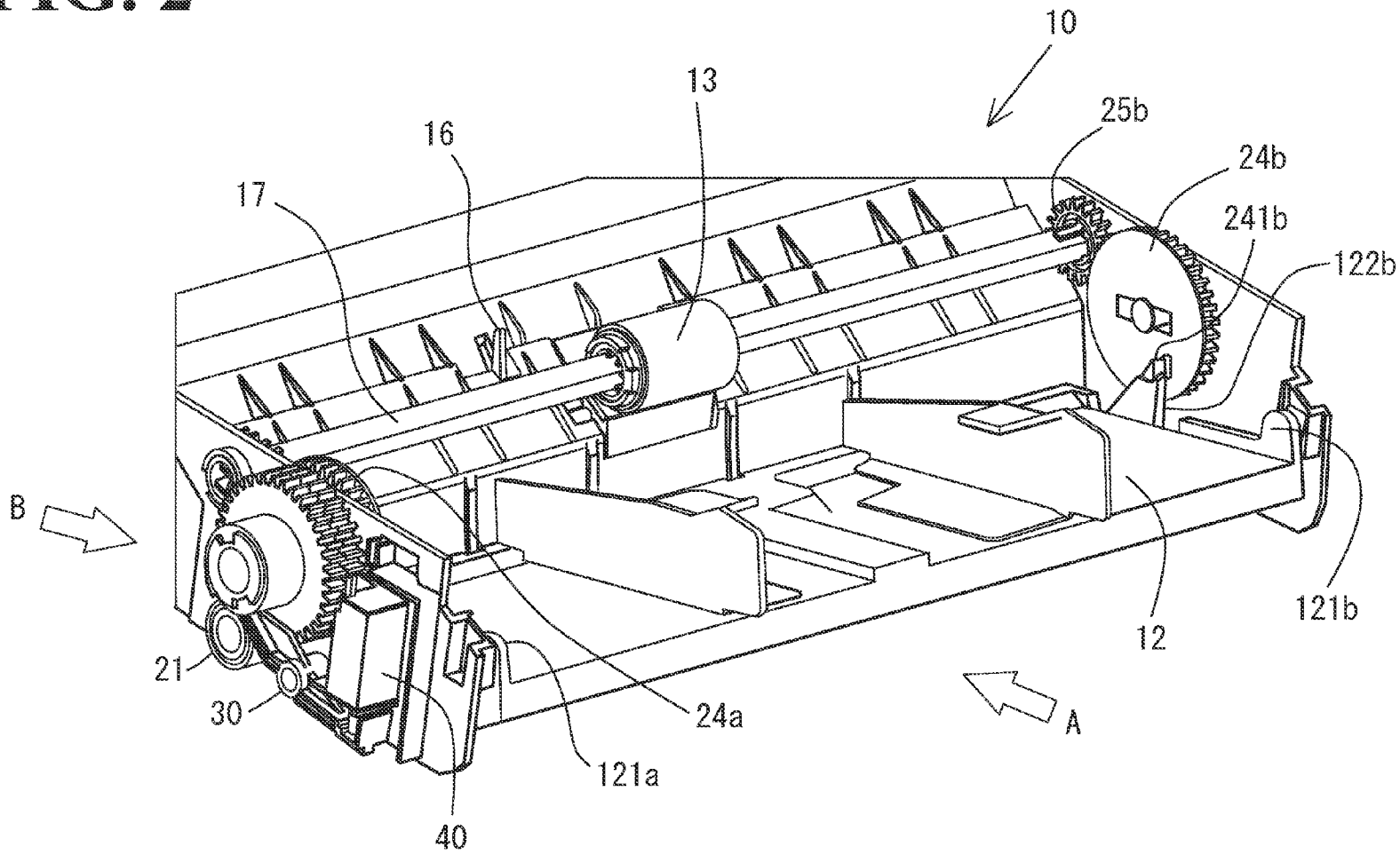
FIG. 2 is a partial perspective view of a sheet feeder in the image forming apparatus shown in FIG. 1.
Figure 3:
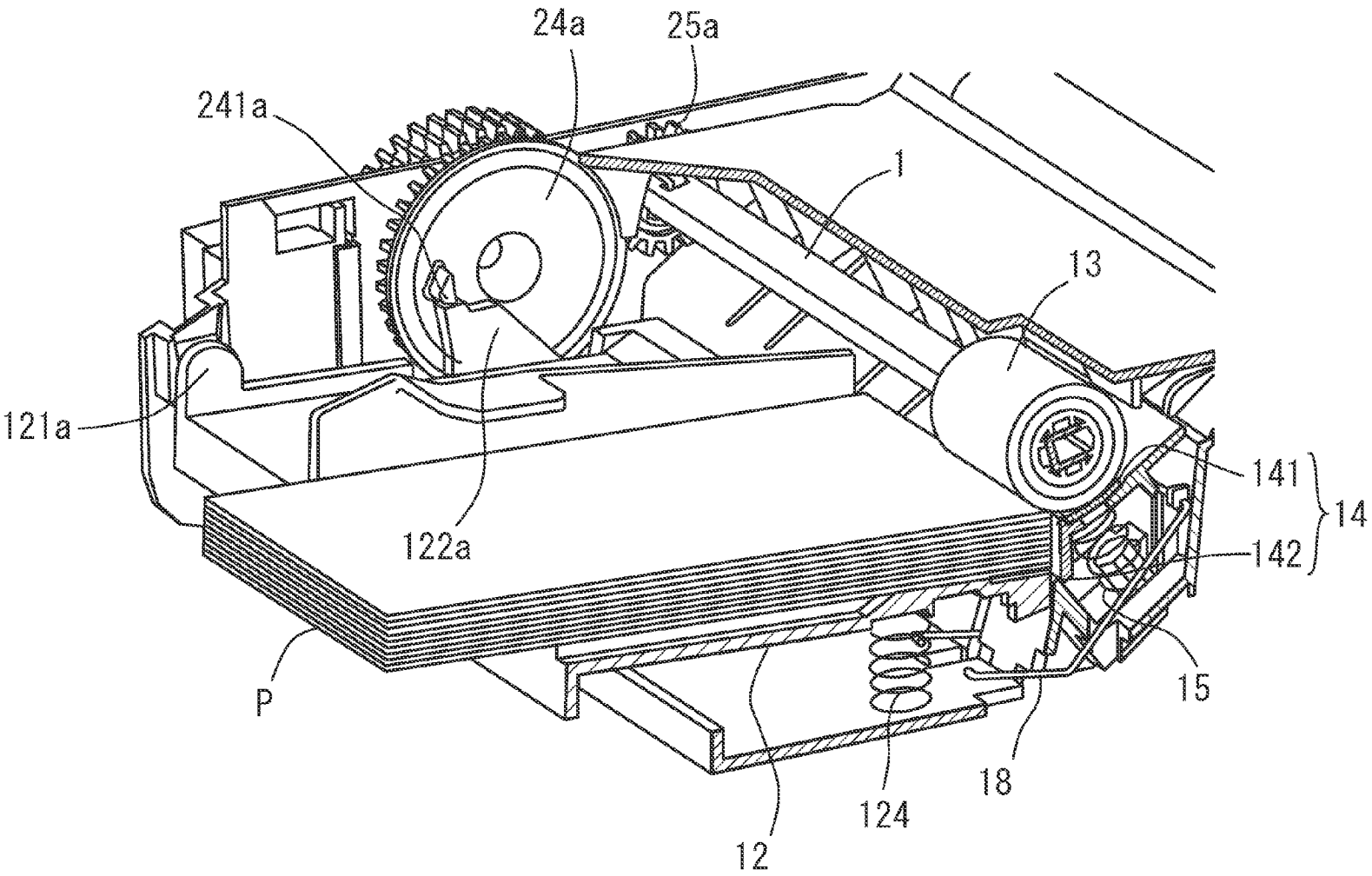
FIG. 3 is a partial perspective, cross-sectional view of the sheet feeder in the image forming apparatus shown in FIG. 1.

Detailed description will now be made on a mechanism to move the recording sheet separator 14 from the contact position to the separate position and a mechanism to idle the sheet feed roller 13. FIGS. 2 and 3 are partial perspective views of the sheet feeder 10. Leading edge portions of recording sheets P in the conveyance direction are stacked on the elevating plate 12. The elevating plate 12 is supported by a shaft 121*a* and a shaft 121*b* on left and right sides, as seen in a direction indicated by the arrow A in FIG. 2, in such a manner that a portion of the elevating plate 12 on the sheet feed roller 13 side is vertically movable. As shown in FIG. 3, the elevating plate 12 is constantly urged toward the sheet feed roller 13 by a helical compression spring 124.

Figure 4:
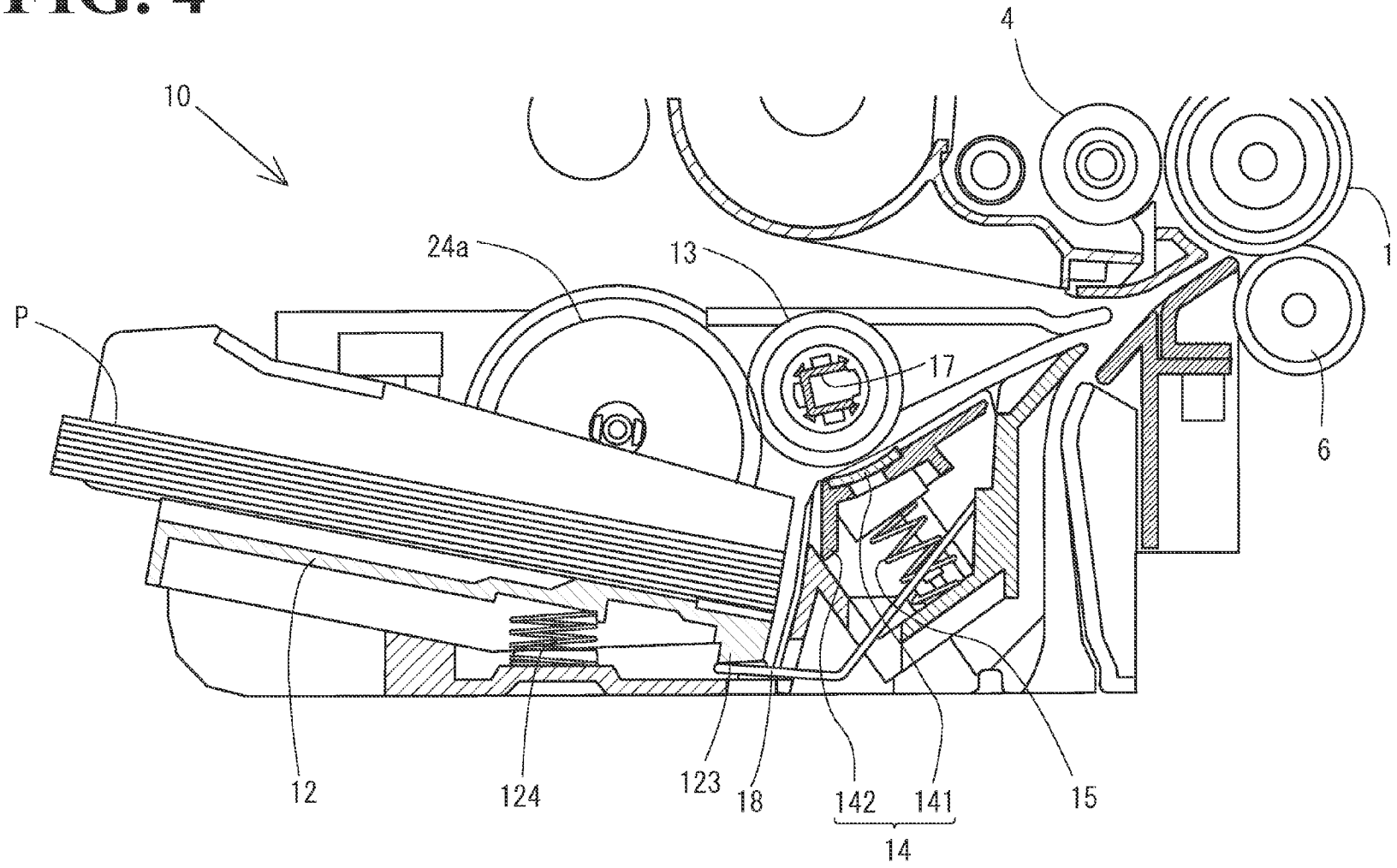
FIG. 4 is a cross-sectional view of the sheet feeder when a sheet feed operation is not being performed.
Figure 5:
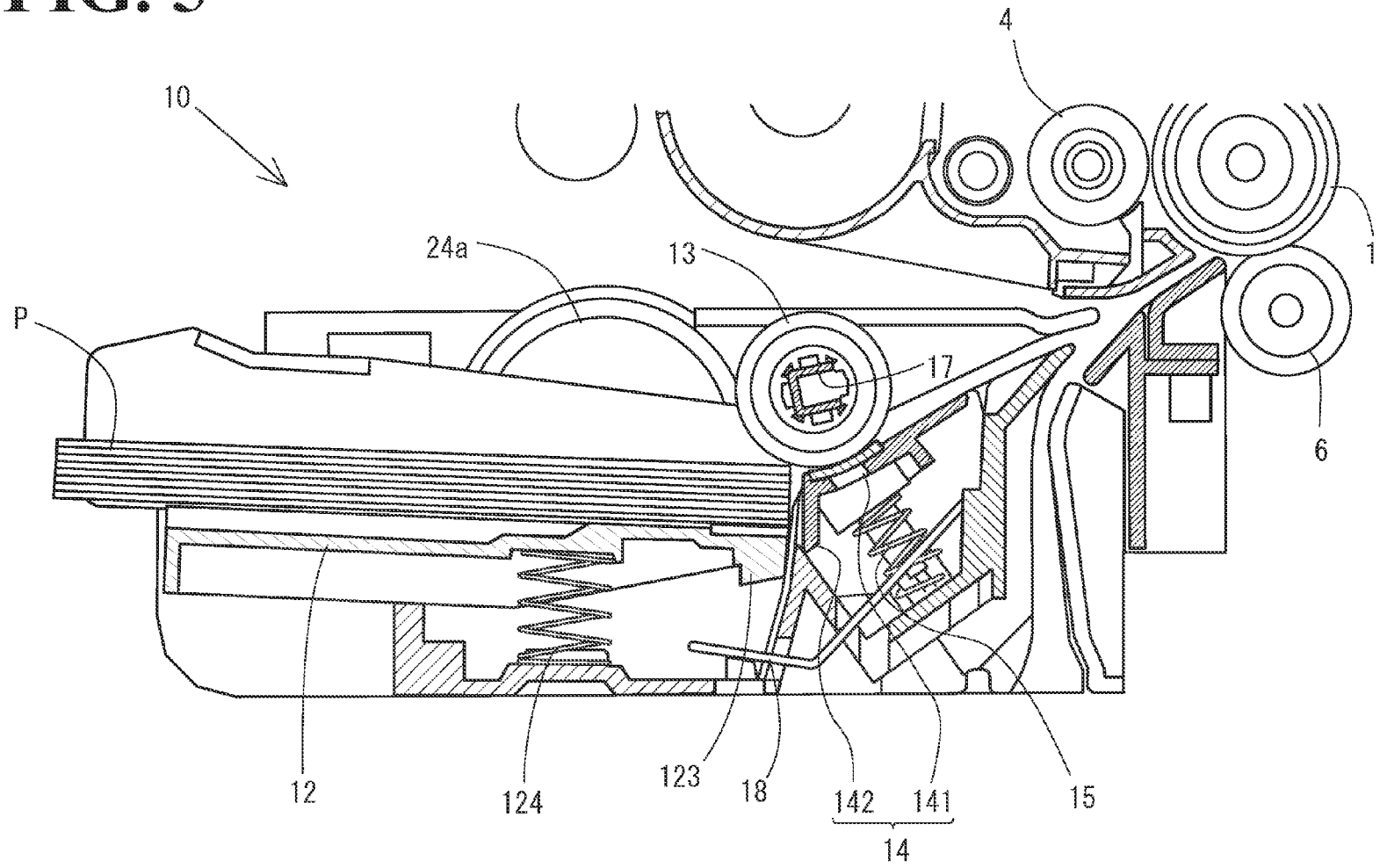
FIG. 5 is a cross-sectional view of the sheet feeder when a sheet feed operation is being performed.

Protrusions 122*a* and 122*b* are respectively formed on left and right side portions of the elevating plate 12. Cam protrusions 241*a* and 241*b* are respectively formed on inside surfaces of cam gears 24*a* and 24*b* rotatably disposed on a housing. The cam gears 24*a* and 24*b* rotate to bring the cam protrusions 241*a* and 241*b* into contact with the protrusions 122*a* and 122*b* of the elevating plate 12 and press down the protrusions 122*a* and 122*b*. Thus, the elevating plate 12 is pressed down against urging force of the helical compression spring 124. FIG. 4 is a vertical cross-sectional view of this state. The cam gears 24*a* and 24*b* rotate to disengage the cam protrusions 241*a* and 241*b* from the protrusions 122*a* and 122*b*. Then, the elevating plate 12 is moved upwardly by the urging force of the helical compression spring 124 and pressed against the sheet feed roller 13. FIG. 5 is a vertical cross-sectional view of this state.

Figure 6:
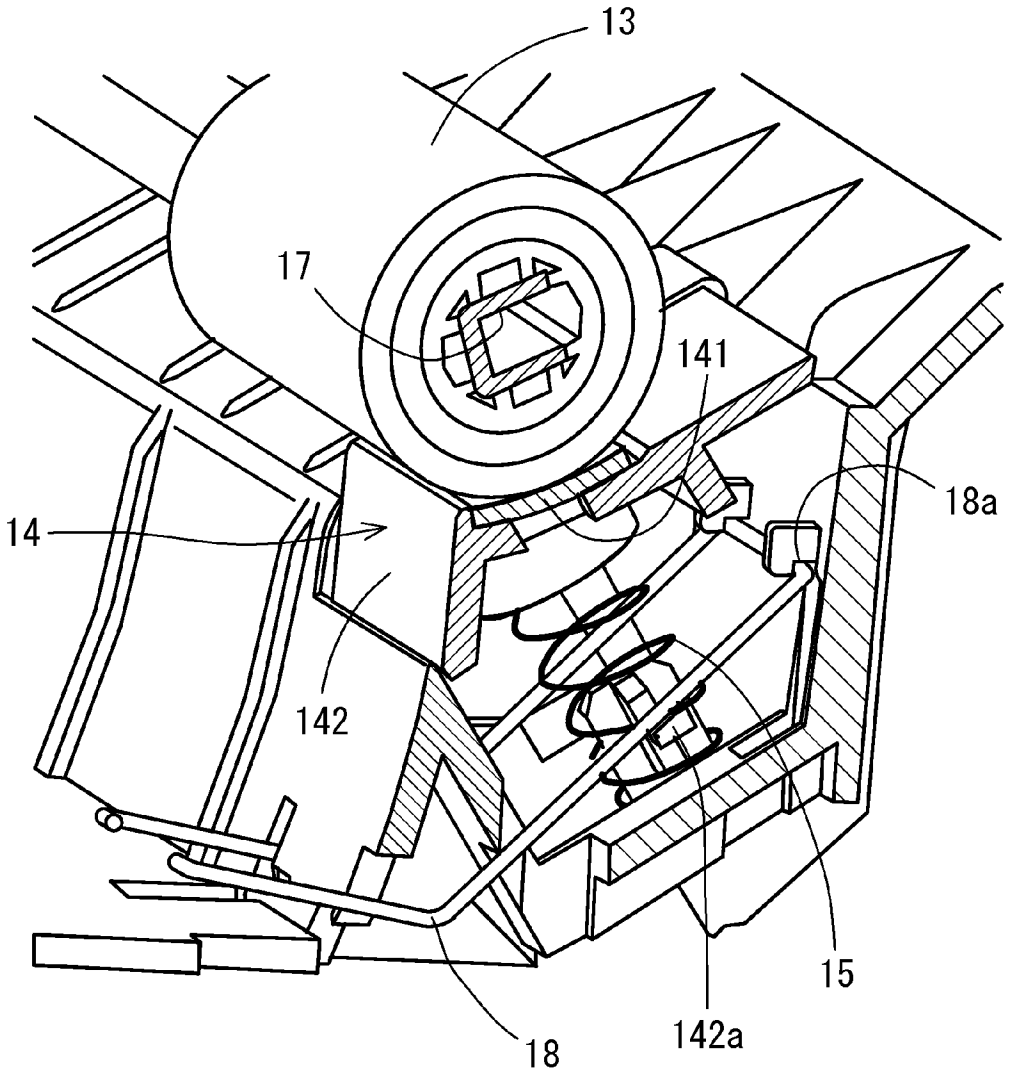
FIG. 6 is a partial perspective, cross-sectional view of the sheet feeder in which a recording sheet separator is at a contact position.

As shown in FIG. 6, the recording sheet separator 14 is pressed against the sheet feed roller 13 and feeds recording sheets P one by one to the conveyance path. The recording sheet separator 14 includes a friction pad 141 and a holder 142. The friction pad 141 is in contact with the sheet feed roller 13 and clamps the recording sheet P with the sheet feed roller 13. The holder 142 holds the friction pad 141. The recording sheet separator 14 is constantly urged toward the sheet feed roller 13 by the helical compression spring 15. A protrusion 142*a* formed on the holder 142 is in contact with an approximately L-shaped lever 18, which swings on a lever holding portion 18*a* as a fulcrum. A free end of the lever 18 is located below a lever contact portion 123 (shown in FIG. 5) on a leading edge position of the elevating plate 12.

As shown in FIG. 4, when the elevating plate 12 is pressed down against the urging force of the helical compression spring 124, the free end of the lever 18 is pressed down by the lever contact portion 123 of the elevating plate 12, and the lever 18 is swung downwardly on the lever holding portion 18*a* as the fulcrum. Downward swing of the lever 18 presses down the protrusion 142*a* of the holder 142 in contact with the lever 18, thereby moving the recording sheet separator 14 downwardly. Thus, the recording sheet separator 14 is displaced to the position separate from the sheet feed roller 13. As shown in FIG. 5, when the elevating plate 12 is moved upwardly by the urging force of the helical compression spring 124, the lever 18 returns to a normal state, and the recording sheet separator 14 is pressed against the sheet feed roller 13 by the helical compression spring 15. In this manner, the recording sheet separator 14 is moved between the contact position and the separate position with respect to the sheet feed roller 13 in conjunction with vertical movement of the elevating plate 12.

Figure 7:
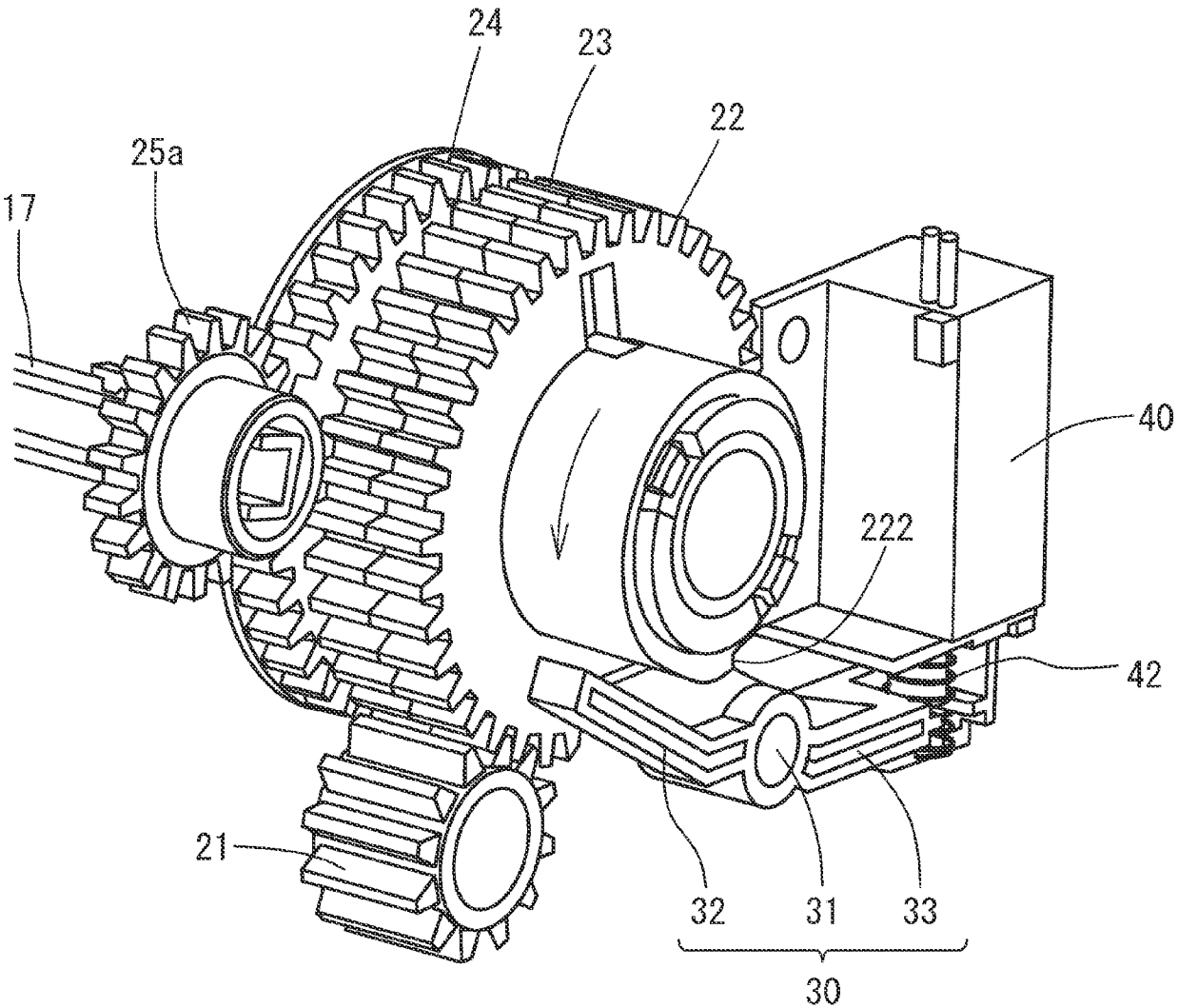
FIG. 7 is a perspective view of a gear drive mechanism, as seen in a direction indicated by the arrow B in FIG. 2.

Next, rotation drive mechanisms of the cam gears 24*a* and 24*b* and the sheet feed roller 13 will be described. As shown in FIGS. 2 and 3, the sheet feed roller 13 is disposed on the drive shaft 17. Coupling gears 25*a* and 25*b* disposed on both ends of the drive shaft 17 respectively mesh with the cam gears 24*a* and 24*b*. FIG. 7 is a perspective view as seen in a direction indicated by the arrow B in FIG. 2. In FIG. 7, a base plate of the main body to hold the gear train is omitted.

As shown in FIG. 7, a ratchet tooth-chipped gear 22, a tooth-chipped gear 23, and the cam gear 24*a* are disposed on the same axis. The ratchet tooth-chipped gear 22 and the tooth-chipped gear 23 mesh with a drive gear 21 to transmit torque from the motor 39. The cam gear 24*a* meshes with the coupling gear 25*a*. A stepped portion 222, stepped in a rotation direction, is formed on a side surface of the ratchet tooth-chipped gear 22. A lever 30 is swung about a shaft 31 by a solenoid 40. An engagement portion 32 of the lever 30 engages with the stepped portion 222.

Figure 8:
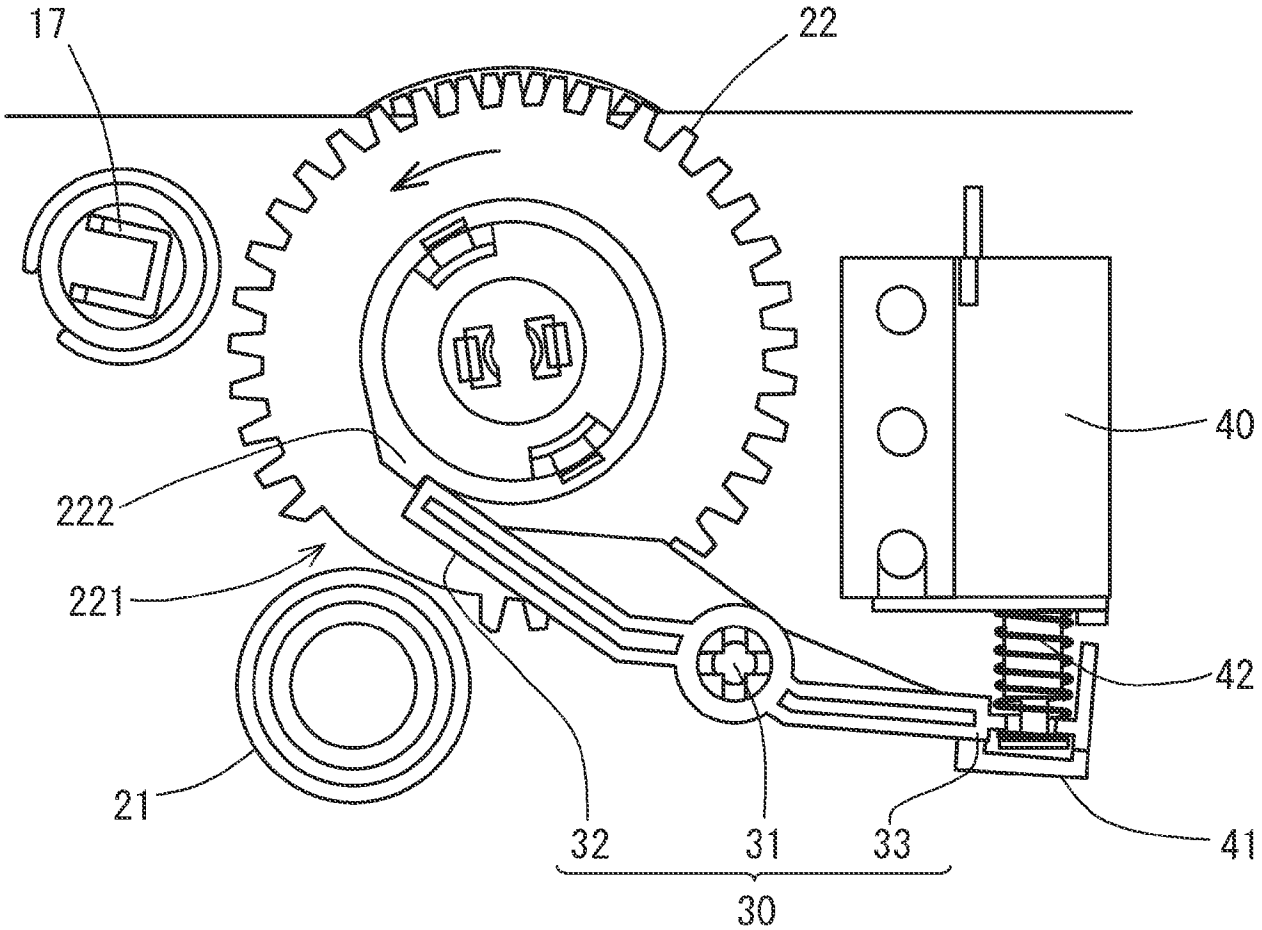
FIG. 8 is a front view of the gear drive mechanism shown in FIG. 7.

FIG. 8 is a front view of the gear train shown in FIG. 7. The lever 30, swingable about the shaft 31, includes the engagement portion 32 and an application portion 33. The application portion 33 is coupled to an operation rod 41 of the solenoid 40. When power is supplied to the solenoid 40, the operation rod 41 is moved upwardly against urging force of a helical compression spring 42 so as to rotate the lever 30 counterclockwise about the shaft 31. This disengages the engagement portion 32 from the stepped portion 222 to make the ratchet tooth-chipped gear 22 rotatable. When power to the solenoid 40 is shut off, the operation rod 41 is moved downwardly by the urging force of the helical compression spring 42 so as to rotate the lever 30 clockwise about the shaft 31. Consequently, the engagement portion 32 is brought into sliding contact with a shaft portion of the ratchet tooth-chipped gear 22. After one rotation of the ratchet tooth-chipped gear 22, the engagement portion 32 engages with the stepped portion 222 again to stop the ratchet tooth-chipped gear 22 from rotating. It should be noted that in the state of the engagement portion 32 and the stepped portion 222 engaging with each other, a tooth-chipped portion 221 of the ratchet tooth-chipped gear 22 is opposed to the drive gear 21, and therefore, torque from the drive gear 21 is not transmitted to the ratchet tooth-chipped gear 22.

Figure 9:
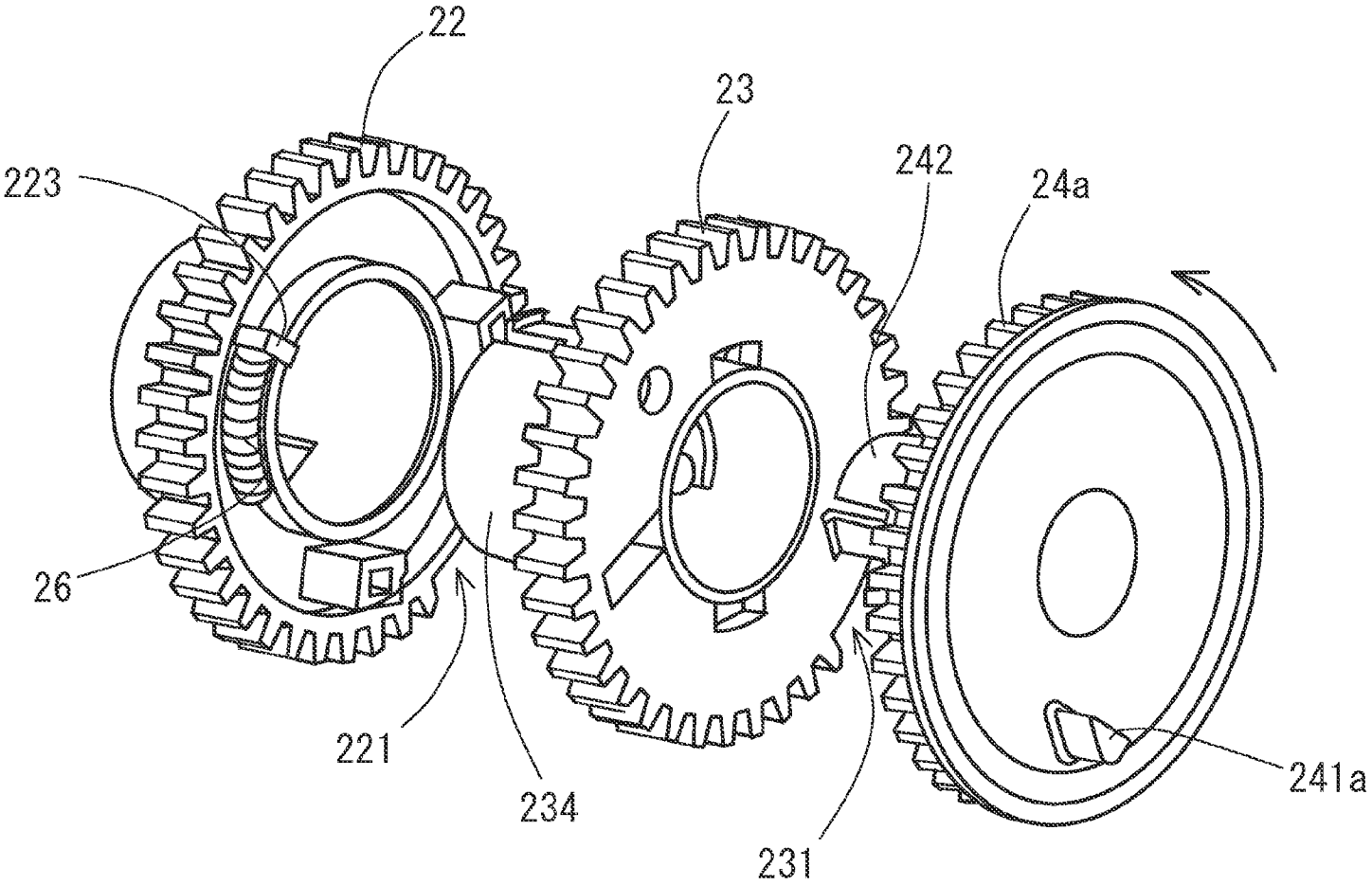
FIG. 9 is an assembly view of the gear drive mechanism shown in FIG. 7.

FIG. 9 is an assembly perspective view of the ratchet tooth-chipped gear 22, the tooth-chipped gear 23, and the cam gear 24*a*. The cam gear 24*a* is coupled to the tooth-chipped gear 23 through a first coupling shaft 242 and rotates integrally with the tooth-chipped gear 23. A tooth-chipped portion 231 is formed on the tooth-chipped gear 23. In this portion, torque from the drive gear 21 is not transmitted. The ratchet tooth-chipped gear 22 is coupled to the tooth-chipped gear 23 through a second coupling shaft 234. However, the ratchet tooth-chipped gear 22 is freely rotatable in a range of a predetermined angle with respect to the tooth-chipped gear 23. Specifically, a groove 233 (shown in FIG. 10B) having a predetermined length is formed in a side surface of the tooth-chipped gear 23 in a circumferential direction. A protrusion 223 is formed on a side surface of the ratchet tooth-chipped gear 22. The protrusion 223 is engaged in the groove 233. A helical compression spring 26 is inserted between an end wall of the groove 233 (shown in FIG. 10B) and the protrusion 223. The tooth-chipped portion 221 is formed on the ratchet tooth-chipped gear 22. In this portion, torque from the drive gear 21 is not transmitted.

Referring to FIGS. 10A to 15C, operations of the gear drive mechanism having the above-described configuration will be described. A, B, and C in each of FIGS. 10 to 15 indicate movements of the ratchet tooth-chipped gear 22, the tooth-chipped gear 23, and the cam gear 24*b* at the same timing. The ratchet tooth-chipped gear 22, the tooth-chipped gear 23, the cam gear 24*a* (24*b*), and the protrusion 122*a* (122*b*) constitute an elevating plate swinging mechanism.

Figure 10C:
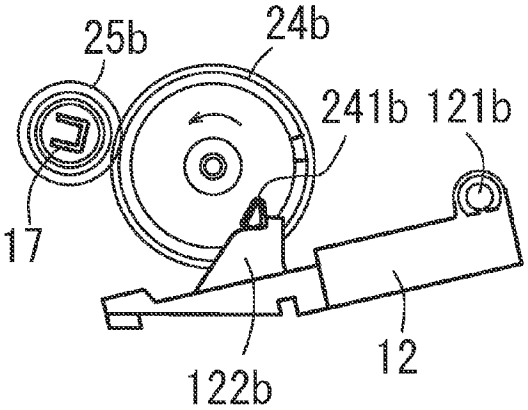
FIGS. 10A to 10C are diagrams for describing an operation of the gear drive mechanism.
Figure 10B:
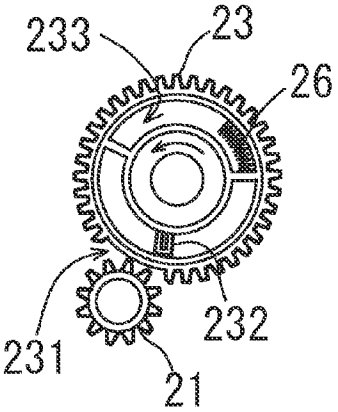
Figure 10A:
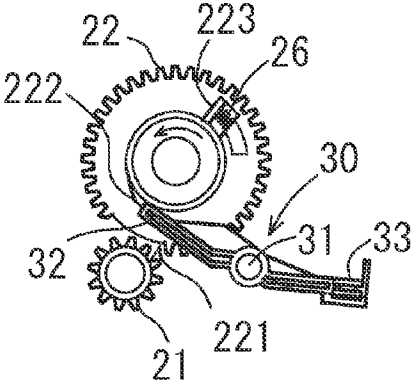

FIGS. 10A to 10C are views of the gear drive mechanism in a standby state. As shown in FIG. 10A, the engagement portion 32 of the lever 30 engages with the stepped portion 222 to stop the ratchet tooth-chipped gear 22 from rotating. The tooth-chipped portion 221 of the ratchet tooth-chipped gear 22 is opposed to the drive gear 21 in such a manner that torque from the drive gear 21 is not transmitted to the ratchet tooth-chipped gear 22. As shown in FIG. 10B, the tooth-chipped portion 231 of the tooth-chipped gear 23 is opposed to the drive gear 21 in such a manner that torque from the drive gear 21 is not transmitted to the tooth-chipped gear 23, either. In this state, the helical compression spring 26 is compressed between the end wall of the groove 233 and the protrusion 223. As shown in FIG. 10C, the cam protrusion 241*b* of the cam gear 24*b* engages with the protrusion 122*b* of the elevating plate 12, and the elevating plate 12 is pressed down. In this state, as shown in FIG. 4, the recording sheet separator 14 is at the position separate from the sheet feed roller 13.

Figure 11C:
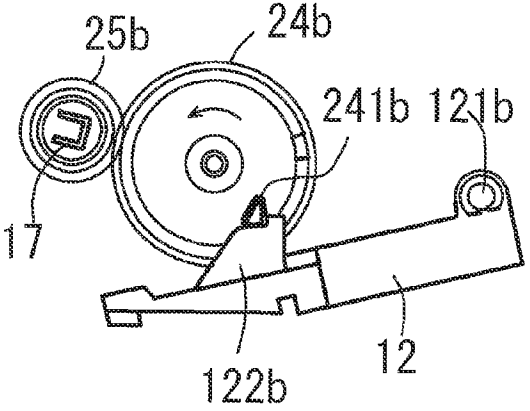
FIGS. 11A to 11C are diagrams for describing an operation of the gear drive mechanism.
Figure 11B:
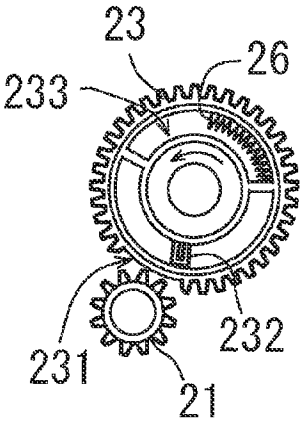
Figure 11A:
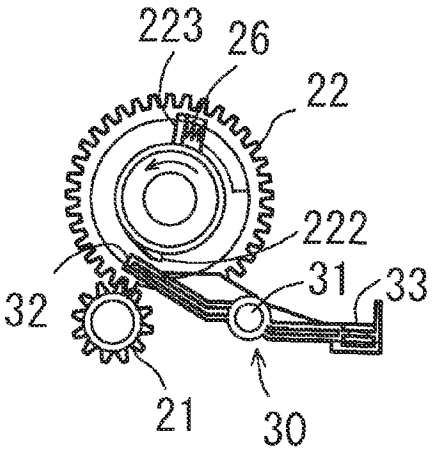

Next, as shown in FIG. 11A, when power is supplied to the solenoid 40 to disengage the engagement portion 32 of the lever 30 from the stepped portion 222, the ratchet tooth-chipped gear 22 is made rotatable. As shown in FIG. 11B, the tooth-chipped gear 23 is not rotatable yet. Consequently, the ratchet tooth-chipped gear 22 is rotated counterclockwise by the helical compression spring 26, thus making a toothed portion of the ratchet tooth-chipped gear 22 mesh with the drive gear 21. At this time, the tooth-chipped gear 23 and the cam gear 24*b* are in standby states respectively shown in FIGS. 11B and 11C.

Figure 12C:
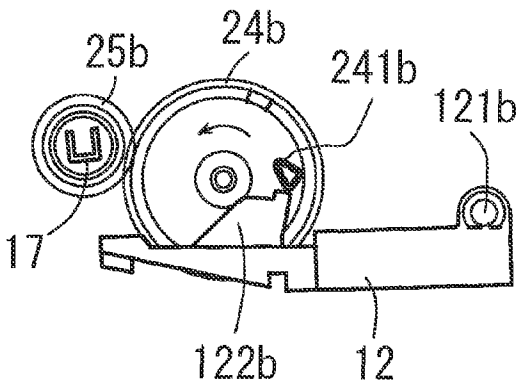
FIGS. 12A to 12C are diagrams for describing an operation of the gear drive mechanism.
Figure 12B:
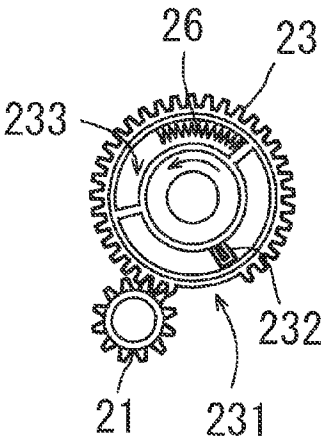
Figure 12A:
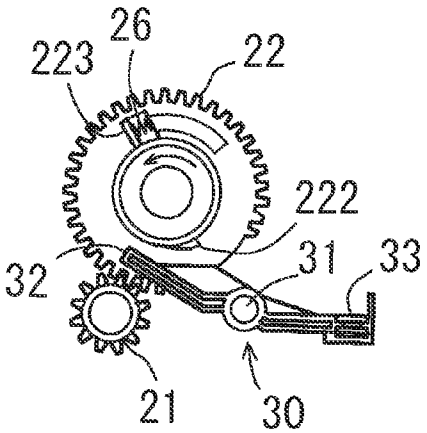

As shown in FIG. 12A, torque from the drive gear 21 is transmitted to and rotates the ratchet tooth-chipped gear 22 to bring the protrusion 223 in contact with the side surface protrusion 232 of the tooth-chipped gear 23. As shown in FIG. 12B, the tooth-chipped gear 23 also starts rotating. In conjunction with rotation of the tooth-chipped gear 23, the cam gear 24*a* also rotates. Then, the coupling gear 25*a* in mesh with the cam gear 24*a* rotates. Thus, the drive shaft 17 on which the coupling gear 25*a* is disposed and the coupling gear 25*b* on the other end of the drive shaft 17 rotate. Then, as shown in FIG. 12C, the cam gear 24*b* in mesh with the coupling gear 25*b* rotates. At this time, the drive shaft 17 of the sheet feed roller 13 also starts rotating.

Figure 13C:
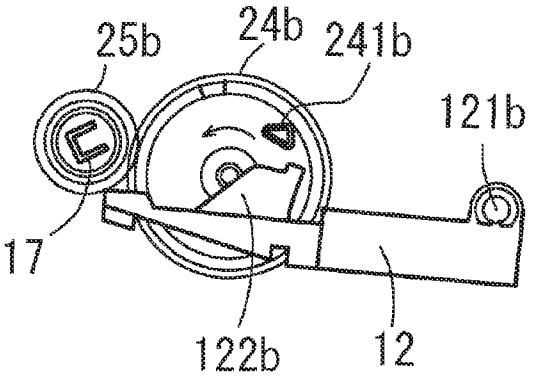
FIGS. 13A to 13C are diagrams for describing an operation of the gear drive mechanism.
Figure 13B:
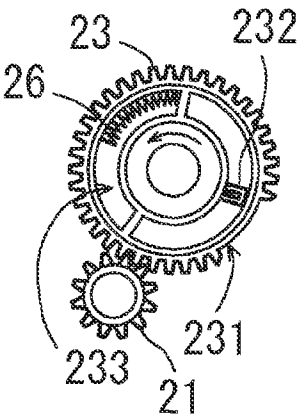
Figure 13A:
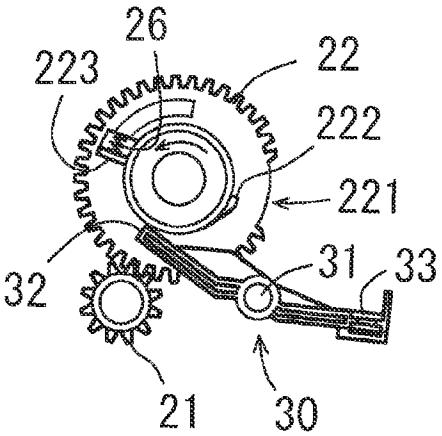

Thus, as shown in FIG. 13C, the cam protrusions 241*a* and 241*b* of the cam gears 24*a* and 24*b* are disengaged from the protrusions 122*a* and 122*b* of the elevating plate 12. Consequently, the elevating plate 12 is moved upwardly by the urging force of the helical compression spring 124 to press recording sheets P on the elevating plate 12 against the sheet feed roller 13. At the same time, the recording sheet separator 14, which has been pressed down by the lever 18, is also moved to the contact position to be pressed against the sheet feed roller 13 by the urging force of the helical compression spring 15 (see FIG. 5). Then, the sheet feed roller 13 rotates to start feeding the recording sheets P. After the engagement portion 32 of the lever 30 is disengaged from the stepped portion 222, the solenoid 40 returns to a non-energized state. As shown in FIG. 13A, the engagement portion 32 of the lever 30 returns to the position in sliding contact with the shaft of the ratchet tooth-chipped gear 22.

Figure 14C:
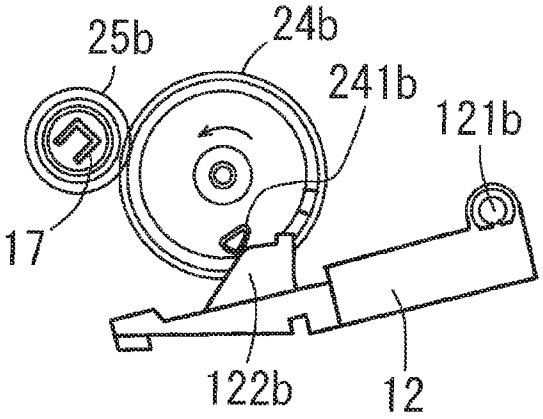
FIGS. 14A to 14C are diagrams for describing an operation of the gear drive mechanism.
Figure 14B:
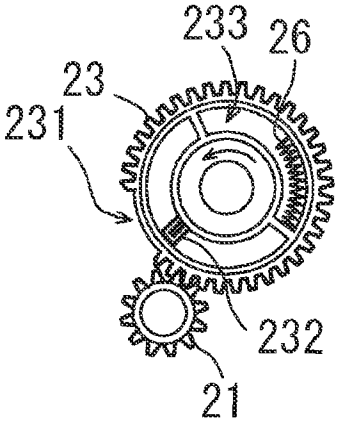
Figure 14A:
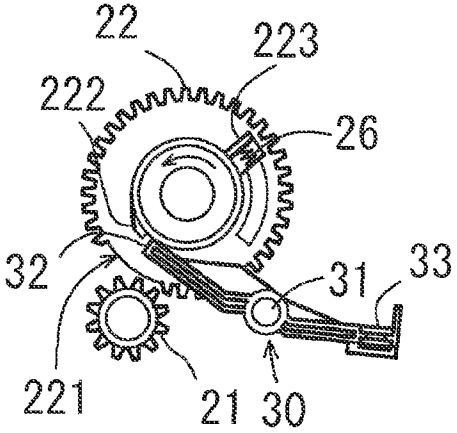

As shown in FIG. 14A, the ratchet tooth-chipped gear 22 further rotates until the tooth-chipped portion 221 of the ratchet tooth-chipped gear 22 reaches the position opposed to the drive gear 21. Then, torque from the drive gear 21 is not transmitted to the ratchet tooth-chipped gear 22. At this time, as shown in FIG. 14B, the tooth-chipped gear 23 meshes with the drive gear 21 and keeps rotating. Consequently, the ratchet tooth-chipped gear 22 rotates a little further by elastic force of the helical compression spring 26. Then, the engagement portion 32 of the lever 30 engages with the stepped portion 222, thereby completely stopping the ratchet tooth-chipped gear 22 from rotating. As shown in FIG. 14C, the cam protrusions 241*a* and 241*b* of the cam gears 24*a* and 24*b* are in contact with inclined surfaces of the protrusions 122*a* and 122*b* of the elevating plate 12, and the elevating plate 12 is gradually pressed down. At the same time, when the elevating plate 12 is pressed down, as shown in FIG. 4, the recording sheet separator 14 is also pressed in a direction away from the sheet feed roller 13 (down) by the lever 18. This stops feeding of the recording sheets P by rotation of the sheet feed roller 13.

Figure 15C:
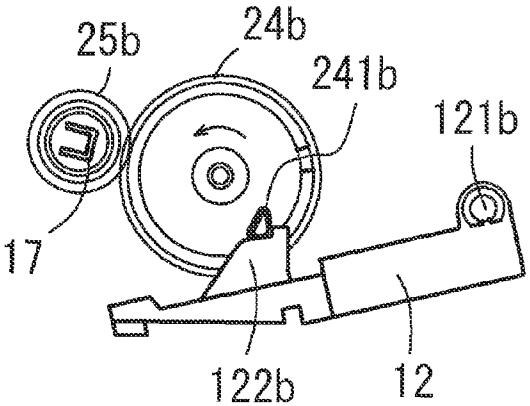
FIGS. 15A to 15C are diagrams for describing an operation of the gear drive mechanism.
Figure 15B:
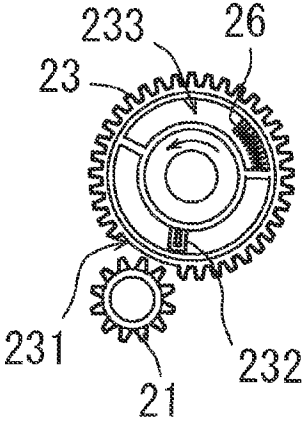
Figure 15A:
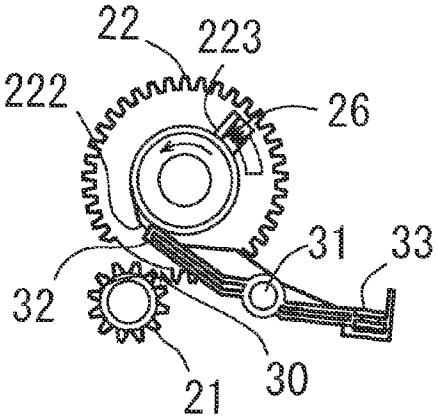

Next, as shown in FIG. 15B, when the tooth-chipped portion 231 of the tooth-chipped gear 23 is opposed to the drive gear 21, the torque from the drive gear 21 is not transmitted to the tooth-chipped gear 23. As shown in FIG. 15C, the cam protrusions 241*a* and 241*b* of the cam gears 24*a* and 24*b* engage with the protrusions 122*a* and 122*b* to press down the elevating plate 12. Then, as shown in FIG. 4, the recording sheet separator 14 is moved to the position separate from the sheet feed roller 13 by the lever 18. At this time, elastic force of the helical compression spring 124 is transmitted to the cam protrusions 241*a* and 241*b* through the protrusions 122*a* and 122*b* so as to slightly rotate the cam gears 24*a* and 24*b*. Consequently, the cam protrusions 241*a* and 241*b* engage with the protrusions 122*a* and 122*b* at predetermined positions. Then, the gear drive mechanism returns to the standby state shown in FIGS. 10A to 10C.

As described above, each time the ratchet tooth-chipped gear 22, the tooth-chipped gear 23, and the cam gears 24*a* and 24*b* rotate one turn, a recording sheet P is drawn out from the recording sheet tray 11 and conveyed to the nip portion between the photoconductor 1 and the transfer roller 6. Specifically, when the leading edge of the recording sheet P thus conveyed is clamped in the nip portion between the heating roller 71 and the pressurizing roller 72, the elevating plate 12 is pressed down. Then, the recording sheet separator 14 is moved to the position separate from the sheet feed roller 13. When the leading edge of the recording sheet P reaches the fixing unit 7, a trailing edge portion of the recording sheet P may extend on the sheet feed roller 13. Even in such a case, the sheet feed roller 13 is prevented from becoming loads of rotations of the transfer roller 6 and the fixing unit 7.

Figure 16:
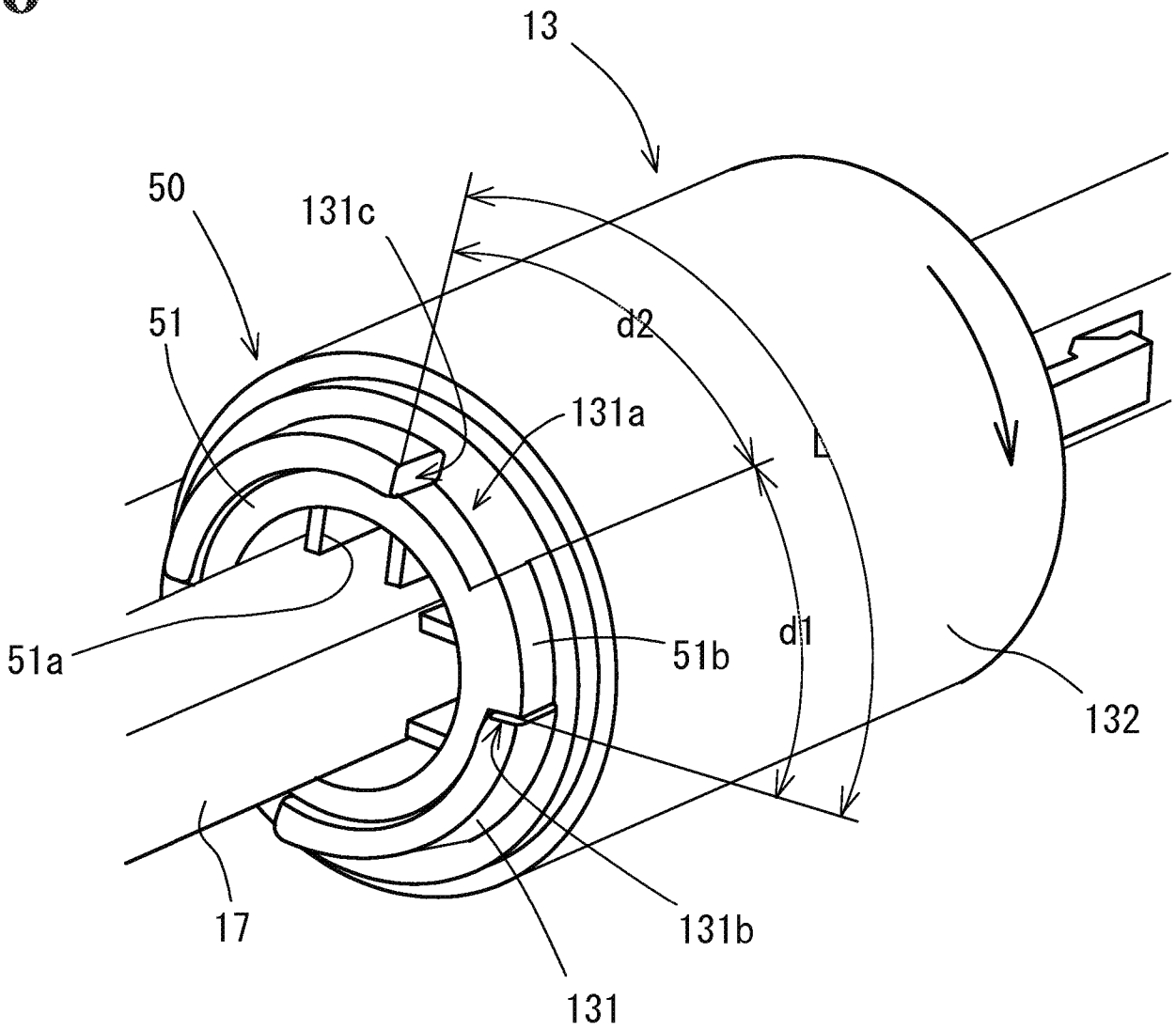
FIG. 16 is a schematic perspective view of an exemplary idling mechanism of a sheet feed roller.

Next, the mechanism to idle the sheet feed roller 13 will be described. As described above, the sheet feed roller 13 is arranged to idle for a predetermined section with respect to the drive shaft 17 in conjunction with the cam gears 24*a* and 24*b* through the coupling gears 25*a* and 25*b*. FIG. 16 is a perspective view of an exemplary idling mechanism.

A cylindrical fixing member 51 is fixed on the drive shaft 17 having an approximately U-shaped cross-section. A plurality of ribs 51*a* parallel to the axial direction are formed on an inner surface of the fixing member 51. A convex portion 51*b* having a circumferential length d1 is formed on an axially end portion of an outer peripheral surface of the fixing member 51. The sheet feed roller 13 is rotatably fitted around the fixing member 51. The sheet feed roller 13 includes a cylindrical base 131 and an elastic layer 132 formed on the outer periphery of the base 131. A notch 131*a* having a circumferential length L is formed on an axially end portion of the base 131.

The circumferential length L of the notch 131*a* is larger than the circumferential length d1 of the convex portion 51*b*. The sheet feed roller 13 is disposed on the fixing member 51 in such a manner that the convex portion 51*b* of the fixing member 51 is positioned in the notch 131*a*. A difference between the circumferential length L of the notch 131*a* and the circumferential length d1 of the convex portion 51*b* is a length d2 of the section in which the sheet feed roller 13 or the drive shaft 17 idles. Specifically, the drive shaft 17 idles until the convex portion 51*b* abuts against a side wall 131*b* of the notch 131*a*. The sheet feed roller 13 idles until a side wall 131*c* of the notch 131*a* abuts against the convex portion 51*a*. It should be noted that in the sheet feed operation by the sheet feed roller 13, the sheet feed roller 13 rotates in a direction indicated by the arrow in FIG. 16.

The idling mechanism 50 may have an engagement configuration of the convex portion 51*b* of the fixing member 51 and the notch 131*a* of the sheet feed roller 13 different from the configuration shown in FIG. 16. For example, the idling mechanism 50 may have an engagement configuration in which a convex portion in a direction parallel to the axial direction is formed on an outer peripheral surface of the fixing member 51, and a concave portion in the direction parallel to the axial direction is formed on an inner surface of the base 131 of the sheet feed roller 13. In this configuration, the circumferential length of the concave portion is larger than the circumferential length of the convex portion. In the above-described embodiment, the elevating plate 12 and the recording sheet separator 14 are vertically moved through the three gears and the cam mechanism by the single drive source. However, vertical movements of the elevating plate 12 and the recording sheet separator 14 may be respectively implemented by different drive sources.

Figure 17:
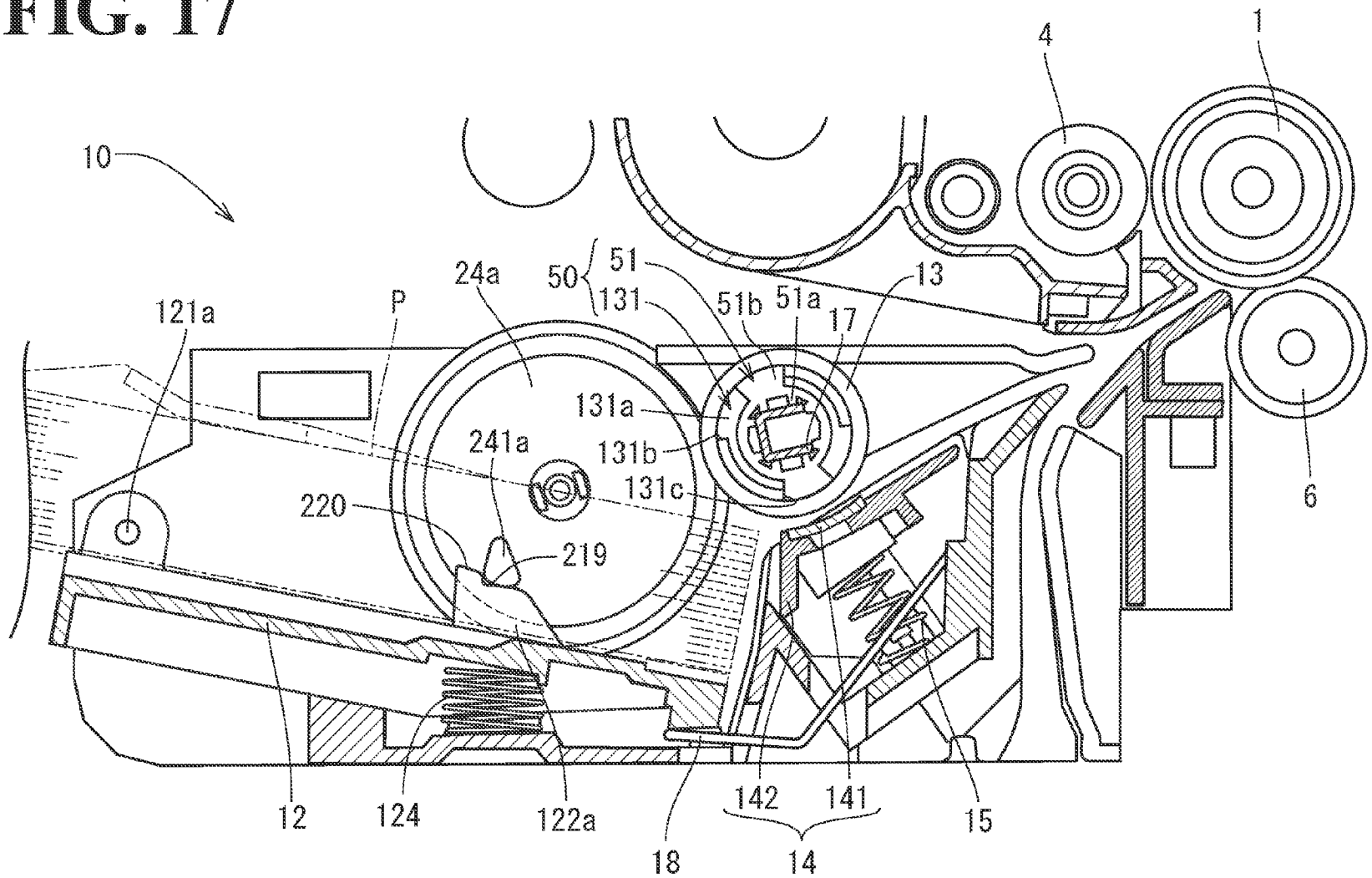
FIG. 17 is a schematic cross-sectional view of the image forming apparatus in a state immediately after the start of a sheet feed operation when the maximum number of recording sheets are stacked.
Figure 18:
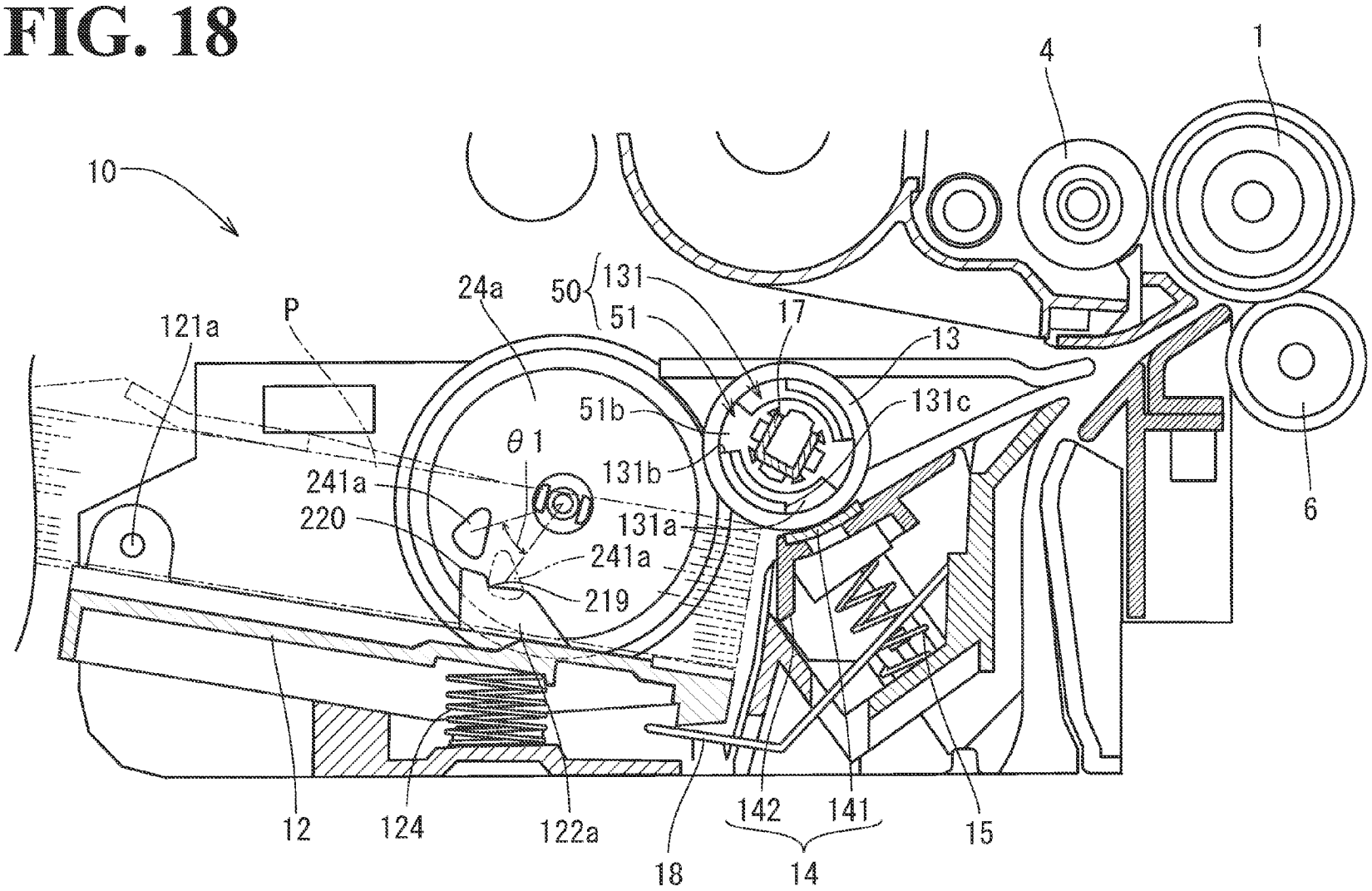
FIG. 18 is a schematic cross-sectional view of the image forming apparatus in a state where recording sheets are pressed against the sheet feed roller when the maximum number of recording sheets are stacked.
Figure 19:
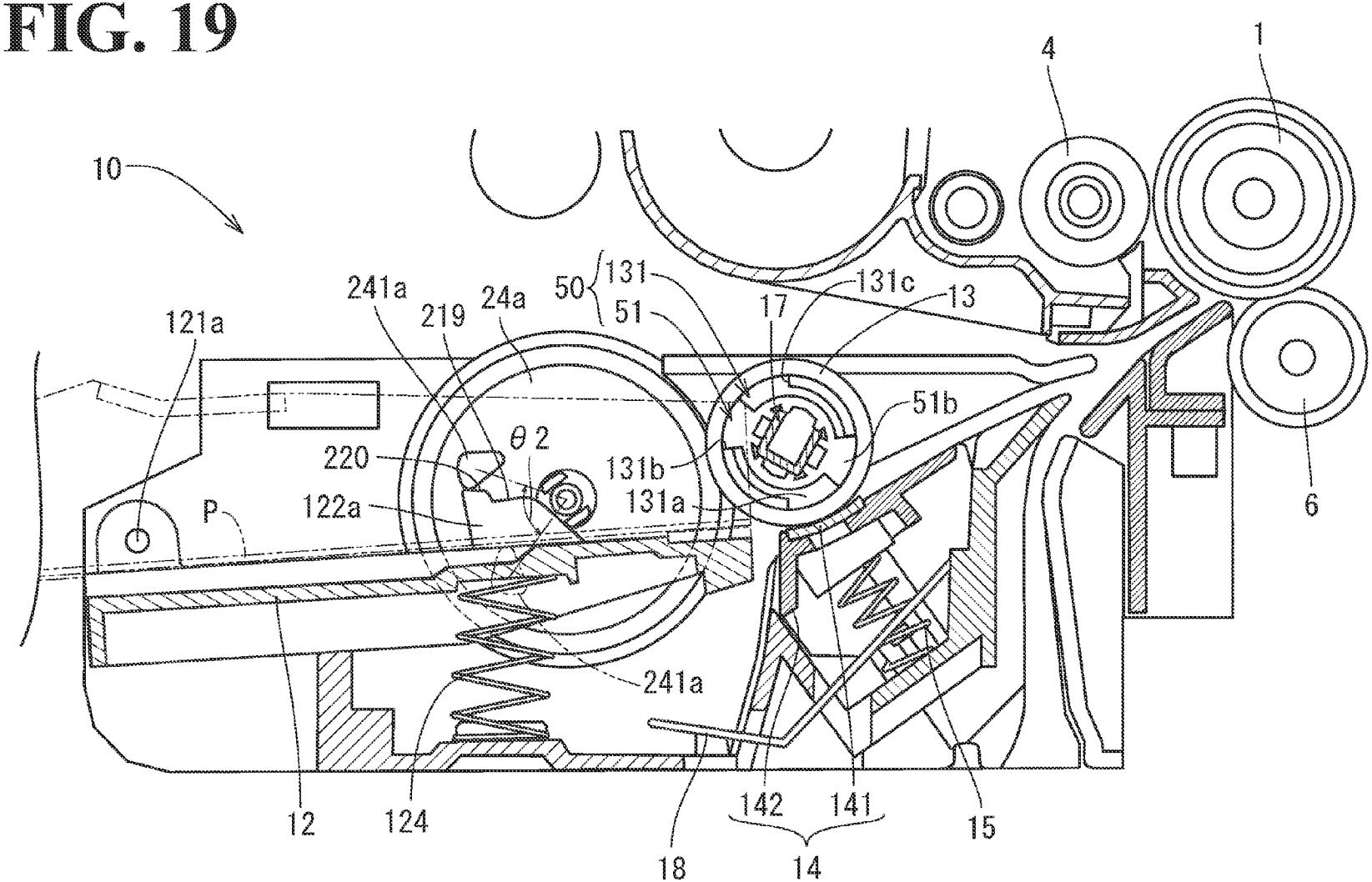
FIG. 19 is a schematic cross-sectional view of the image forming apparatus in a state where a single recording sheet is pressed against the sheet feed roller when the single recording sheet is mounted.
Figure 20:
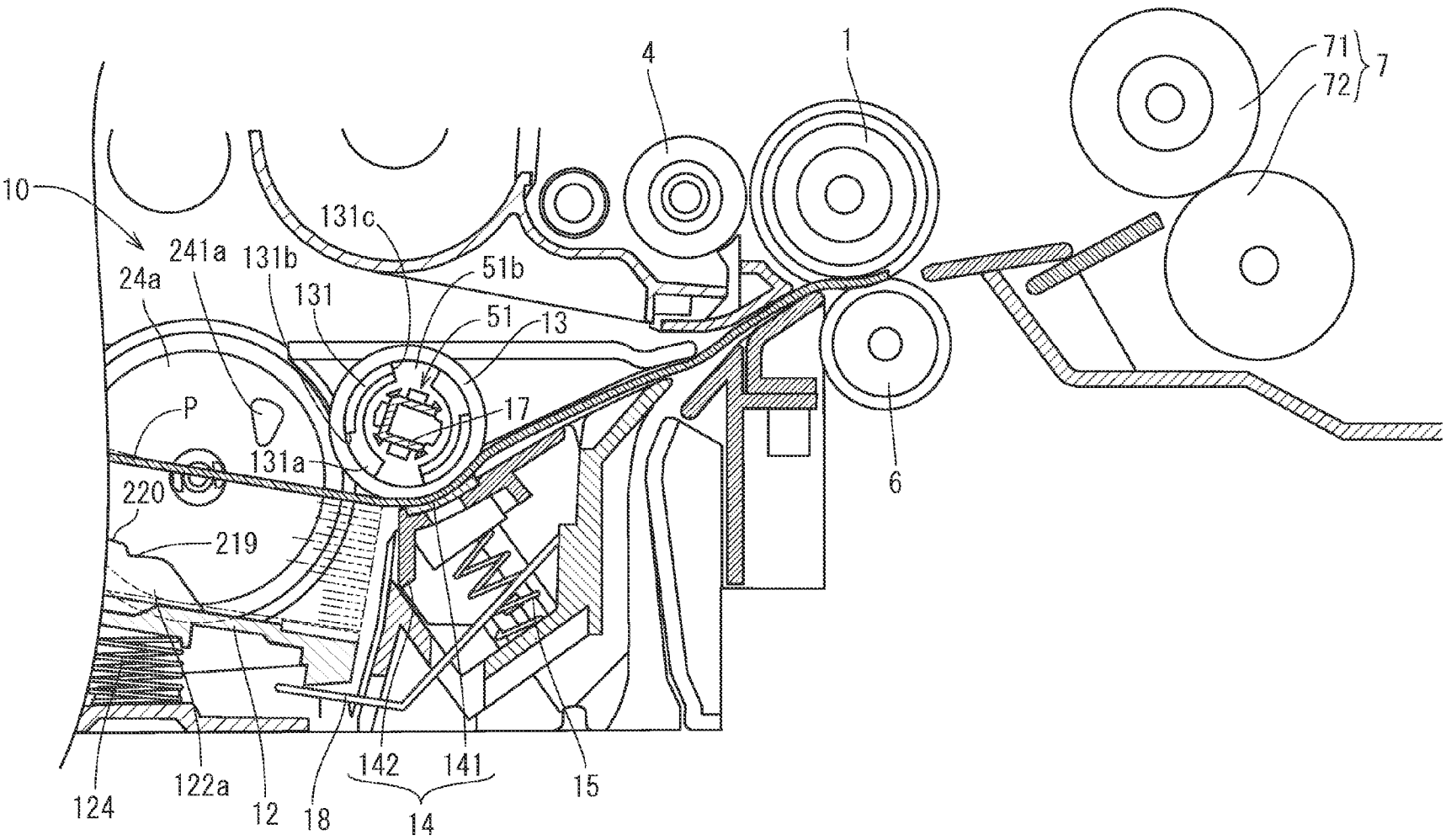
FIG. 20 is a schematic cross-sectional view of the image forming apparatus in a state when a recording sheet is conveyed to a transfer roller.
Figure 21:
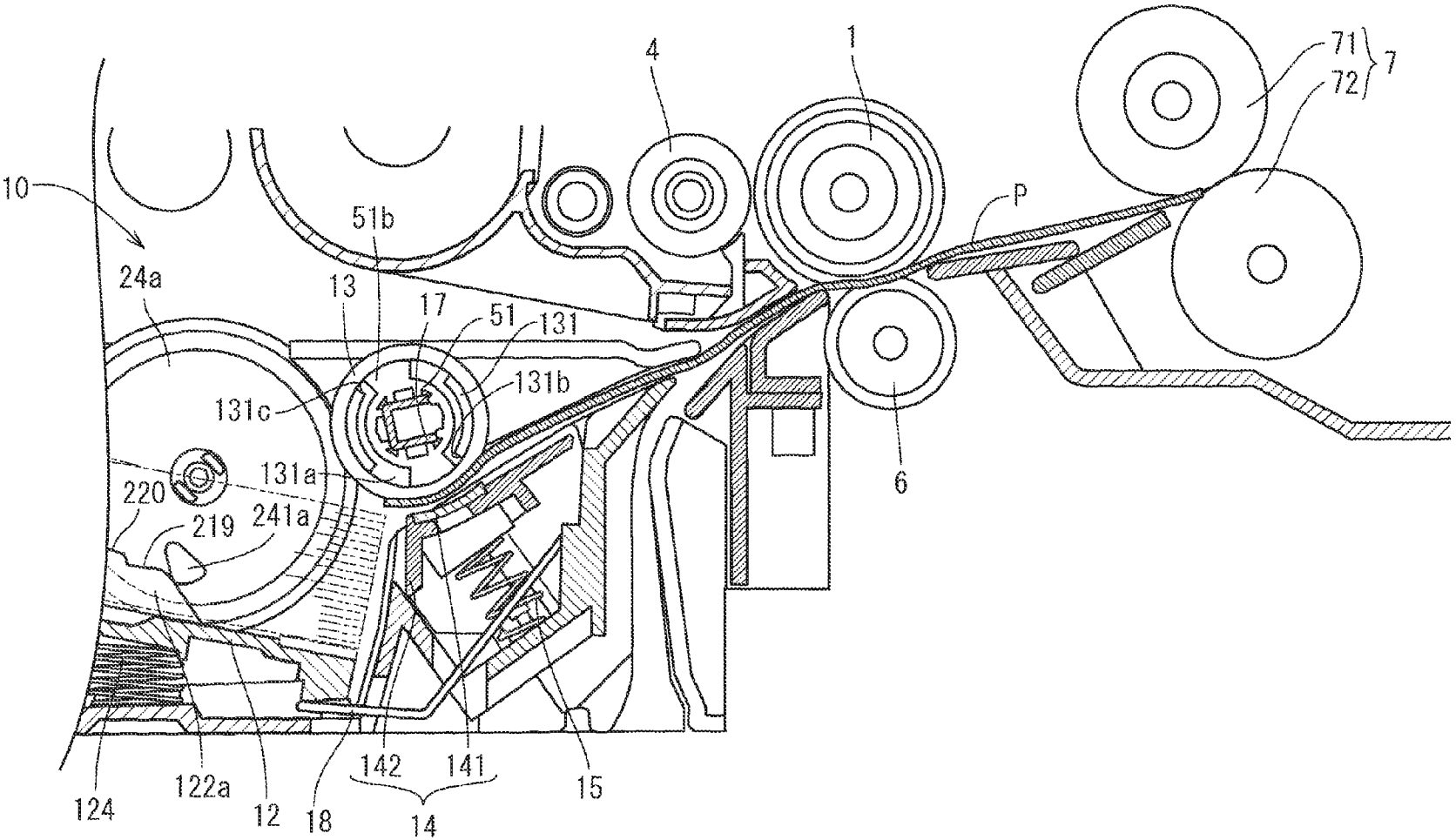
FIG. 21 is a schematic cross-sectional view of the image forming apparatus in a state when a recording sheet is conveyed to a fixing unit.

The sheet feed operation by the sheet feed roller 13 will now be described with reference to FIGS. 17 to 21. FIGS. 17 to 21 are schematic cross-sectional views for describing operations of the components of the image forming apparatus D. FIG. 17 illustrates a state at the start of the sheet feed operation. FIG. 18 illustrates a state in which the maximum number of recording sheets P are stacked. FIG. 19 illustrates a state in which a single recording sheet P is mounted. FIG. 20 illustrates a state when the recording sheet P reaches the transfer roller 6. FIG. 21 illustrates a state when the recording sheet P reaches the fixing unit 7.

As shown in FIG. 17, immediately after the sheet feed operation is started, the cam protrusion 241*a* (241*b*) of the cam gear 24*a* (24*b*) engages with a stepped portion 219 of the protrusion 122*a* (122*b*) of the elevating plate 12. The elevating plate 12 is pressed down, and the recording sheet separator 14 is separate from the sheet feed roller 13. Then, since rotation from the drive gear 21 is transmitted to the cam gear 24*a*, the cam gear 24 rotates in a direction to disengage the cam protrusion 241*a* from the protrusion 122*a*. Also, the torque of the cam gear 24*a* is transmitted to the coupling gear 25*a* attached to one end of the drive shaft 17. Consequently, the drive shaft 17 starts rotating in synchronism with rotation of the cam gear 24*a*. Thus, the sheet feed roller 13 rotates to start feeding the recording sheets P.

FIG. 18 shows the case in which the maximum number of recording sheets P are stacked on the elevating plate 12. Immediately after the engagement between the cam protrusion 241*a* (241*b*) and the protrusion 122*a* (122*b*) is released, the uppermost one of the recording sheets P on the elevating plate 12 is pressed against the sheet feed roller 13. Specifically, when the maximum number of recording sheets P are stacked on the elevating plate 12, the cam protrusion 241*a* (241*b*) of the cam gear 24*a* (24*b*) rotates for an angle θ1 from the position right after the start of the sheet feed operation (see FIG. 17). Then, the recording sheets P on the elevating plate 12 are pressed against the sheet feed roller 13. When the sheet feed roller 13 rotates, the uppermost one of the recording sheets P pressed against the sheet feed roller 13 is drawn out to the conveyance path. Since the recording sheet separator 14 is moved to the position in contact with the sheet feed roller 13 by the helical compression spring 15, only one of the recording sheets P is selectively conveyed to the conveyance path.

FIG. 19 shows the case in which a single recording sheet P is mounted on the elevating plate 12. After the engagement between the cam protrusion 241*a* (241*b*) and the protrusion 122*a* (122*b*) is released, the cam gear 24*a* (24*b*) rotates for a while, and then, the recording sheets P on the elevating plate 12 are pressed against the sheet feed roller 13. Specifically, when a single recording sheet P is mounted on the elevating plate 12, the cam protrusion 241*a* (241*b*) of the cam gear 24*a* (24*b*) rotates for an angle θ2 from the position right after the start of the sheet feed operation (see FIG. 17). Then, the recording sheet P on the elevating plate 12 is pressed against the sheet feed roller 13. When the sheet feed roller 13 rotates, the uppermost recording sheet P pressed against the sheet feed roller 13 is drawn out to the conveyance path.

In the above-described manner, the sheet feed roller 13 draws out the uppermost recording sheet P on the elevating plate 12 to the conveyance path. Then, the recording sheet detection sensor 16 detects the leading edge of the recording sheet P, and an electrostatic latent image is formed on the photoconductor 1. The electrostatic latent image is formed into a toner image at the developer 4. The photoconductor 1 conveys the toner image to the nip area between the photoconductor 1 and the transfer roller 6 to transfer the toner image to the recording sheet P conveyed by the sheet feed roller 13. At this time, as shown in FIG. 20, the recording sheet P to which the toner image is transferred is clamped between the photoconductor 1 and the transfer roller 6, and at the same time, clamped between the sheet feed roller 13 and the recording sheet separator 14.

Subsequently, by rotations of the sheet feed roller 13, the photoconductor 1, and the transfer roller 6, the recording sheet P is conveyed to the fixing unit 7. When the leading edge of the recording sheet P reaches the nip portion between the heating roller 71 and the pressurizing roller 72, as shown in FIG. 21, the leading edge of the recording sheet P is clamped between the heating roller 71 and the pressurizing roller 72. At the same time, a middle portion of the recording sheet P is clamped between the photoconductor 1 and the transfer roller 6. Since the recording sheet separator 14 is separate from the sheet feed roller 13, as shown in FIG. 21, the trailing edge of the recording sheet P is unclamped from the sheet feed roller 13 and the recording sheet separator 14.

At this time, the cam gear 24*a* (24*b*) stops rotating, and the drive shaft 17 also stops rotating. Consequently, the transfer roller 6 and the fixing unit 7 rotate to draw out the recording sheet P, and thus, the sheet feed roller 13 is idled. Therefore, the sheet feed roller 13 is idled until the side wall 131*c* of the notch 131*a* abuts against the convex portion 51*b*. To be ready for conveyance of the next recording sheet P, the relationship between the sheet feed roller 13 and the drive shaft 17 returns to the initial state, as shown in FIG. 17.

Figure 22:
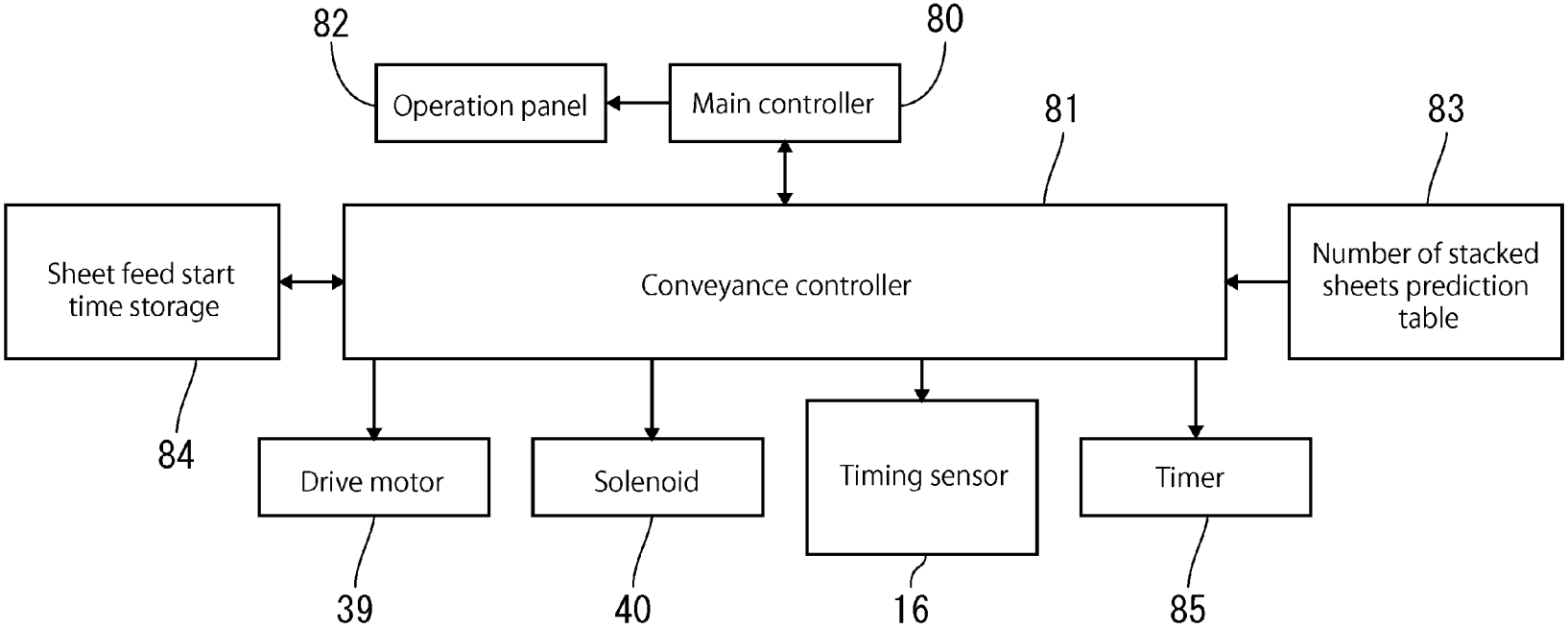
FIG. 22 is a control block diagram illustrating an internal configuration of the image forming apparatus.

As shown in FIG. 22, the image forming apparatus D includes a main controller 80, a conveyance controller 81, and an operation panel 82. The main controller 80 controls operations of the components of the apparatus. The conveyance controller 81 controls operations of the parts in relation to conveyance of recording sheets P. The operation panel 82 displays states of the image forming apparatus D and receives instructions from a user. In response to an image formation starting signal from the main controller 80, the conveyance controller 81 starts the sheet feed operation of the recording sheets P. Also, in response to an image formation ending signal from the main controller 80, the conveyance controller 81 ends the sheet feed operation of the recording sheets P.

Referring to a number of stacked sheets prediction table 83, the conveyance controller 81 predicts the number of stacked recording sheets P on the elevating plate 12 of the recording sheet tray 11. Based on the predicted number of sheets, a sheet feed start timing is determined, and the conveyance controller 81 stores the sheet feed start timing in a sheet feed start time storage 84. The conveyance controller 81 gives a control signal to the drive motor 39 to rotate the transfer roller 6, the fixing unit 7, and the sheet discharge roller pair 8 to convey the recording sheets P. Also, the conveyance controller 81 gives a control signal to the solenoid 40 to feed the recording sheets P from the recording sheet tray 11. Further, based on an input signal from the timing sensor 16, the conveyance controller 81 confirms the sheet feed timing of the recording sheets P fed from the recording sheet tray 11, and measures time by a timer 85.

Figure 23:
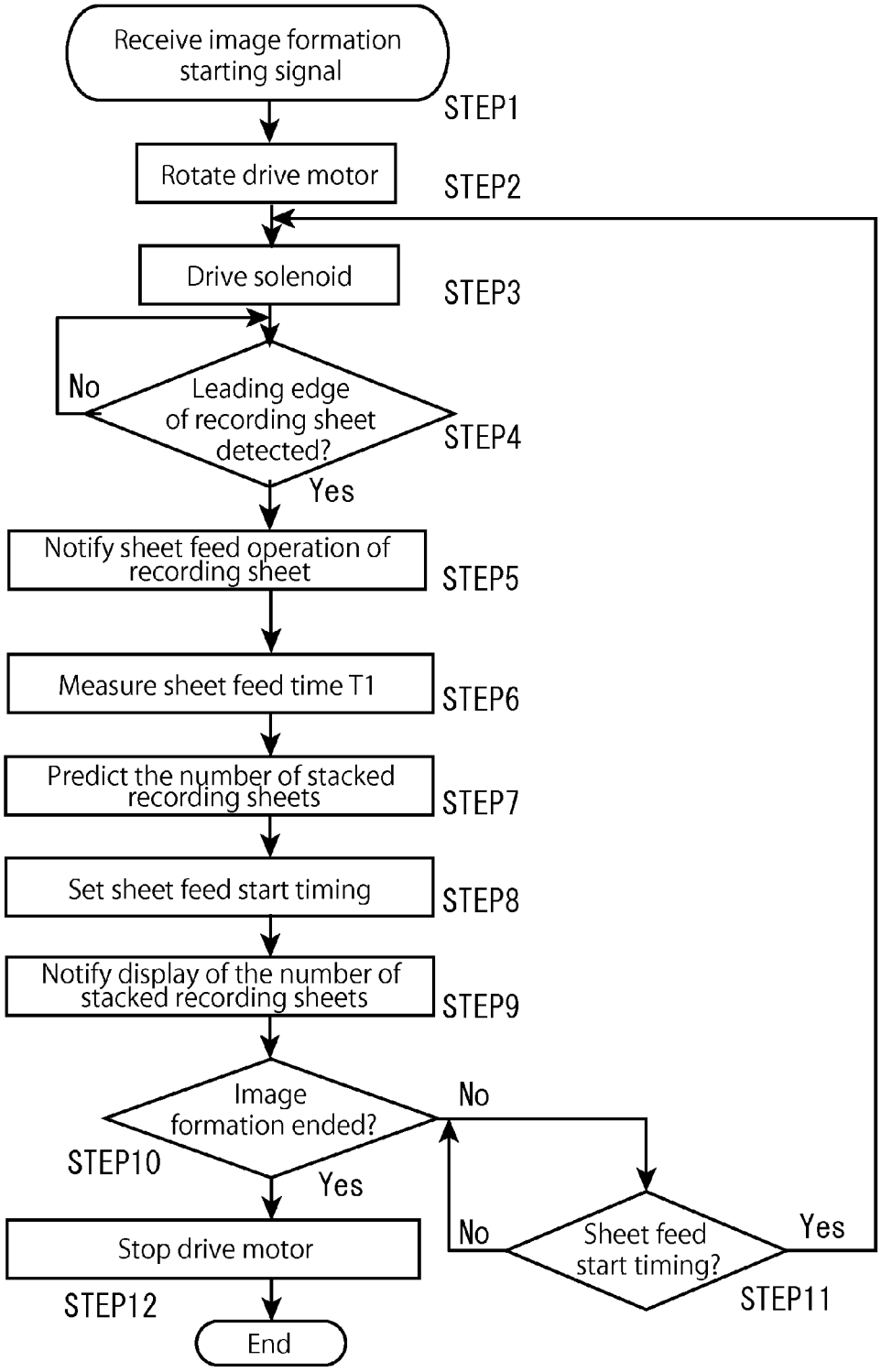
FIG. 23 is a flowchart illustrating operations of a conveyance controller when conveying a recording sheet.

Conveyance control operations by the conveyance controller 81 when the control block of the image forming apparatus D has the configuration shown in FIG. 22 will be described below with reference to FIG. 23. In response to an image formation starting signal from the main controller 80 (STEP 1), the conveyance controller 81 starts rotation by the drive motor 39 to convey recording sheets for image formation (STEP 2). By rotating the drive motor 39, the photoconductor 1, the electrification roller 2, the transfer roller 6, the heating roller 71, the pressurizing roller 72, and the sheet discharge roller pair 8 start rotating.

Then, the conveyance controller 81 supplies power to operate the solenoid 40 to start a sheet feed operation of the recording sheets P (STEP 3). The solenoid 40 is driven to release the engagement of the ratchet tooth-chipped gear 22 by the lever 30, and the ratchet tooth-chipped gear 22 is rotated by the torque from the drive gear 21. Thus, as described above, the elevating plate 12 is swung upwardly, and the sheet feed roller 13 is rotated. Consequently, when the recording sheets P stacked on the elevating plate 12 are pressed against the sheet feed roller 13, the sheet feed roller 13 draws out the uppermost recording sheet P to the conveyance path.

Starting the sheet feed operation of the recording sheets P in this manner, the conveyance controller 81 confirms an input signal from the timing sensor 16, and detects whether the leading edge of the recording sheet P passes (STEP 4). At this time, when the conveyance controller 81 confirms the leading edge of the recording sheet P based on the input signal from the timing sensor 16 (Yes at STEP 4), the conveyance controller 81 notifies the main controller 80 that the leading edge of the recording sheet P has passed (STEP 5). Then, based on a time measuring operation by the timer 85, the conveyance controller 81 measures a period of time T1 from starting to drive the solenoid 40 to passing of the leading edge of the recording sheet P (hereinafter referred to as "sheet feed time T1") (STEP 6).

As described above, depending on the number of stacked recording sheets P on the elevating plate 12, time until the recording sheets P are pressed against the sheet feed roller 13 differs. Consequently, as the number of stacked recording sheets P decreases, the sheet feed time T1 increases. Therefore, the conveyance controller 81 measures the sheet feed time T1, and refers to the number of stacked sheets prediction table 83 storing the number of stacked recording sheets P corresponding to the sheet feed time T1. Thus, the conveyance controller 81 predicts the number of stacked recording sheets P on the elevating plate 12 (STEP 7). In the example shown in FIG. 23, the conveyance controller 81 predicts the number of stacked recording sheets P as follows. When the sheet feed time T1 is less than Tx1 [msec], the number of stacked recording sheets P is equal to or more than Px1 [sheets]. When the sheet feed time T1 is equal to or more than Tx1 [msec] and less than Tx2 (Tx2>Tx1) [msec], the number of stacked recording sheets P is equal to or more than Px2 (Px2<Px1) [sheets] and less than Px1 [sheets]. When the sheet feed time T1 is equal to or more than Tx2 [msec] and less than Tx3 (Tx3>Tx2) [msec], the number of stacked recording sheets P is equal to or more than Px3 (Px3<Px2) [sheets] and less than Px2 [sheets]. When the sheet feed time T1 is equal to or more than Tx3 [msec], the number of stacked recording sheets P is less than Px3 [sheets].

After predicting the number of stacked recording sheets P, the conveyance controller 81 sets a next sheet feed start timing of the recording sheet P based on the predicted number of stacked recording sheets P (STEP 8). That is, the conveyance controller 81 sets a timing to drive the solenoid 40 in the next sheet feed operation of the recording sheet P. At this time, the conveyance controller 81 sets a period of time (sheet feed interval time) T2 from driving the solenoid 40 in the current sheet feed operation to starting to drive the solenoid 40 in the next sheet feed operation. Consequently, the conveyance controller 81 sets and stores the next sheet feed start timing (sheet feed start time) in the sheet feed start time storage 84.

When the sheet feed time T1 (time from driving the solenoid 40 to detection of passing of the leading edge of the recording sheet P by the timing sensor 16) is short, the conveyance controller 81 predicts that the number of stacked recording sheets P is large, and sets the sheet feed interval time T2 to be long. When the sheet feed time T1 is long, the conveyance controller 81 predicts that the number of stacked recording sheets P is small, and sets the sheet feed interval time T2 to be short. Specifically, in the example shown in FIG. 23, when predicting that the number of stacked recording sheets P is equal to or more than Px1 [sheets], the conveyance controller 81 sets that the sheet feed interval time T2 is Ty1 [msec]. When predicting that the number of stacked recording sheets P is equal to or more than Px2 [sheets] and less than Px1 [sheets], the conveyance controller 81 sets that the sheet feed interval time T2 is Ty2 (Ty2<Ty1) [msec]. When predicting that the number of stacked recording sheets P is equal to or more than Px3 [sheets] and less than Px2 [sheets], the conveyance controller 81 sets that the sheet feed interval time T2 is Ty3 (Ty3<Ty2) [msec]. When predicting that the number of stacked recording sheets P is less than Px3 [sheets], the conveyance controller 81 sets that the sheet feed interval time T2 is Ty4 (0<Ty4<Ty3) [msec].

It should be noted that the sheet feed interval time T2 may be set based on the sheet feed time T1 instead of the number of stacked recording sheets P. Specifically, the conveyance controller 81 stores, as reference time Tx0, sheet feed time when the number of stacked recording sheets P is the maximum. When measuring the sheet feed time T1 in the sheet feed operation of the recording sheets P, the conveyance controller 81 calculates a difference value ΔT1 (=T1−Tx0) between the measured sheet feed time T1 and the reference time Tx0. Also, the conveyance controller 81 stores, as reference time Ty0, sheet feed interval time when the number of stacked recording sheets P is the maximum. The conveyance controller 81 sets that the sum Ty0+ΔT1 of the reference time Ty0 and the difference value ΔT1 as the sheet feed interval time T2.

Next, the conveyance controller 81 notifies the main controller 80 of the number of stacked recording sheets P predicted at STEP 7 (STEP 9). In response to the predicted number of stacked recording sheets P from the conveyance controller 81, the main controller 80 makes the operation panel 82 to display the predicted number of stacked recording sheets P. At this time, the main controller 80 confirms the thickness of the recording sheet P based on a kind of paper and a basis weight of the recording sheet P input from the operation panel 82 by the user, and approximately calculates the predicted number of stacked recording sheets P. Then, the operation panel 82 displays the predicted number of stacked recording sheets P calculated by the main controller 80 using a numeral and a diagrammatic indicator. Thus, the user checks the display of the operation panel 82 to recognize the approximate number of stacked recording sheets P (number of the rest of the recording sheets P).

Then, the conveyance controller 81 confirms whether the conveyance controller 81 receives an image formation ending signal from the main controller 80 (STEP 10). When the conveyance controller 81 does not receive the image formation ending signal from the main controller 80 (No at STEP 10), the conveyance controller 81 compares a sheet feed start timing stored in the storage 84 with time measured by the timer 85, and confirms whether time reaches the sheet feed start timing (STEP 11). When time reaches the sheet feed start timing (Yes at STEP 11), the operation shifts to STEP 3 to drive the solenoid 40 and start a sheet feed operation of the next recording sheet P. When the conveyance controller 81 receives the image formation ending signal from the main controller 80 (Yes at STEP 10), the conveyance controller 81 stops the drive motor 39 to end the image formation operation (STEP 12).

As described above, when the number of stacked recording sheets P is large, the sheet feed time T1*a* is short, and consequently, the conveyance controller 81 sets the sheet feed interval time T2*a* to be long. When the number of stacked recording sheets P is small, the sheet feed time T1*b* is long, and consequently, the conveyance controller 81 sets the sheet feed interval time T2*b* to be short. That is, irrespective of the number of stacked recording sheets P, the conveyance controller 81 sets the next sheet feed start timing in such a manner that the leading edge of the recording sheet P reaches the measurement position by the timing sensor 16 at the same timing.

Thus, in the image forming apparatus D, irrespective of the number of recording sheets P stacked on the elevating plate 12, the recording sheets P are drawn out to the conveyance path at the same timing by the sheet feed roller 13. That is, the recording sheets P are conveyed for the same length by the sheet feed roller 13 so as to stabilize the conveyance speed of the recording sheets P. Then, time from starting the sheet feed operation until the recording sheet P reaching the nip portion at the transfer roller 6 is made constant to make the image transfer timing at the transfer roller 6 approximately the same. Therefore, the position of transfer image formation on the photoconductor 1 is made approximately constant, thereby maintaining high printing accuracy in the transfer unit made up of the photoconductor 1 and the transfer roller 6.

Furthermore, the image forming apparatus according to the embodiment may be a multifunction peripheral (MFP) having a copy function, a scanner function, a printer function, and a fax function. The image forming apparatus may also be a printer, a copying machine or a facsimile.

According to the embodiment of the present invention, based on the sheet feed time from starting the sheet feed operation of a recording sheet to detecting the leading edge of the fed recording sheet, a sheet feed start timing of a next recording sheet is set to be changeable. Consequently, irrespective of the amount of recording sheets stacked on the elevating plate, a recording sheet is pressed against the sheet feed roller at the same timing as in the previous sheet feed operation. Therefore, drawing of the recording sheet to the conveyance path by the sheet feed roller does not become irregular depending on the amount of recording sheets stacked on the elevating plate but is constantly executed at the same timing. As a result, the recording sheet is constantly conveyed to the transfer roller and the fixing unit respectively at the same timings. This stabilizes the conveyance of the recording sheet, and also maintains high accuracy in printing the recording sheet.

Obviously, numerous modifications and variations of the present invention are possible in light of the above teachings. It is therefore to be understood that within the scope of the appended claims, the present invention may be practiced otherwise than as specifically described herein.

What is claimed:

1. An image forming apparatus configured to feed a recording sheet from a sheet feed roller, clamp the recording sheet between an image carrier and a transfer roller, transfer a toner image to the recording sheet from the image carrier while conveying the recording sheet, and fix the transferred toner image on the recording sheet at a fixing unit, the image forming apparatus comprising:

an elevating plate on which recording sheets are stacked;

an elevating plate swinging mechanism configured to swing the elevating plate to move vertically;

a rotation drive mechanism configured to rotate the sheet feed roller in synchronism with the elevating plate swinging mechanism;

a recording sheet detector configured to detect a leading edge of each recording sheet fed from the sheet feed roller; and a conveyance controller configured to drive the elevating plate swinging mechanism to swing the elevating plate and configured to rotate the sheet feed roller to feed a recording sheet, a time interval from start of a preceding recording sheet feed operation by the sheet feed roller to start of a next recording sheet feed operation being controlled to be a fixed time interval between a plurality of consecutive recording sheets, the conveyance controller being configured to, when executing a sheet feed operation of the recording sheet, measure sheet feed time from starting the sheet feed operation to detecting the leading edge of the recording sheet by the recording sheet detector, and configured to set a sheet feed start timing for starting a sheet feed operation of a next recording sheet based on the measured sheet feed time.

2. The image forming apparatus according to claim 1, wherein the conveyance controller is configured to measure, as the sheet feed time, time from starting to drive the elevating plate swinging mechanism to detecting the leading edge of the recording sheet by the recording sheet detector.

3. The image forming apparatus according to claim 1, wherein the conveyance controller is configured to, as the sheet feed time increases, set time until the sheet feed start timing at a smaller value.

4. The image forming apparatus according to claim 1, further comprising a data table indicating a relationship between sheet feed interval time until a next sheet feed start timing and the sheet feed time, wherein the conveyance controller is configured to measure the sheet feed time, refer to the data table, calculate the sheet feed interval time, and set the sheet feed start timing.

5. The image forming apparatus according to claim 1, wherein the conveyance controller is configured to, based on the measured sheet feed time, predict a number of the recording sheets stacked on the elevating plate.

6. The image forming apparatus according to claim 5, further comprising a data table indicating a relationship between the number of the recording sheets stacked on the elevating plate and the sheet feed time, wherein the conveyance controller is configured to measure the sheet feed time, refer to the data table, and predict the number of the stacked recording sheets.

7. The image forming apparatus according to claim 5, further comprising a display configured to display the number of the recording sheets stacked on the elevating plate, wherein the number of the stacked recording sheets, which has been predicted by the conveyance controller, is displayed in the display.

8. The image forming apparatus according to claim 1, further comprising a recording sheet separator configured to move between a position in contact with the sheet feed roller and a position separate from the sheet feed roller in synchronism with the elevating plate moving vertically.

9. The image forming apparatus according to claim 2, wherein the conveyance controller is configured to, as the sheet feed time increases, set time until the sheet feed start timing at a smaller value.

10. The image forming apparatus according to claim 2, further comprising a data table indicating a relationship between sheet feed interval time until a next sheet feed start timing and the sheet feed time, wherein the conveyance controller is configured to measure the sheet feed time, refer to the data table, calculate the sheet feed interval time, and set the sheet feed start timing.

11. The image forming apparatus according to claim 3, further comprising a data table indicating a relationship between sheet feed interval time until a next sheet feed start timing and the sheet feed time, wherein the conveyance controller is configured to measure the sheet feed time, refer to the data table, calculate the sheet feed interval time, and set the sheet feed start timing.

12. The image forming apparatus according to claim 9, further comprising storing a data table indicating a relationship between sheet feed interval time until a next sheet feed start timing and the sheet feed time, wherein the conveyance controller is configured to measure the sheet feed time, refer to the data table, calculate the sheet feed interval time, and set the sheet feed start timing.

13. The image forming apparatus according to claim 2, wherein the conveyance controller is configured to, based on the measured sheet feed time, predict a number of the recording sheets stacked on the elevating plate.

14. The image forming apparatus according to claim 3, wherein the conveyance controller is configured to, based on the measured sheet feed time, predict a number of the recording sheets stacked on the elevating plate.

15. The image forming apparatus according to claim 4, wherein the conveyance controller is configured to, based on the measured sheet feed time, predict a number of the recording sheets stacked on the elevating plate.

16. The image forming apparatus according to claim 9, wherein the conveyance controller is configured to, based on the measured sheet feed time, predict a number of the recording sheets stacked on the elevating plate.

17. The image forming apparatus according to claim 10, wherein the conveyance controller is configured to, based on the measured sheet feed time, predict a number of the recording sheets stacked on the elevating plate.

18. The image forming apparatus according to claim 11, wherein the conveyance controller is configured to, based on the measured sheet feed time, predict a number of the recording sheets stacked on the elevating plate.

19. The image forming apparatus according to claim 12, wherein the conveyance controller is configured to, based on the measured sheet feed time, predict a number of the recording sheets stacked on the elevating plate.

20. The image forming apparatus according to claim 6, further comprising a data table indicating a relationship between the number of the recording sheets stacked on the elevating plate and the sheet feed time, wherein the conveyance controller is configured to measure the sheet feed time, refer to the data table, and predict the number of the stacked recording sheets.

21. The image forming apparatus of claim 1, wherein the elevating plate swinging mechanism is structured to move the elevating plate each time the recording sheets are fed one by one.

* * * * *